US008527265B2

(12) United States Patent
Reznik et al.

(10) Patent No.: US 8,527,265 B2
(45) Date of Patent: Sep. 3, 2013

(54) LOW-COMPLEXITY ENCODING/DECODING OF QUANTIZED MDCT SPECTRUM IN SCALABLE SPEECH AND AUDIO CODECS

(75) Inventors: Yuriy Reznik, San Diego, CA (US); Pengjun Huang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1009 days.

(21) Appl. No.: 12/255,604

(22) Filed: Oct. 21, 2008

(65) Prior Publication Data

US 2009/0234644 A1 Sep. 17, 2009

Related U.S. Application Data

(60) Provisional application No. 60/981,814, filed on Oct. 22, 2007.

(51) Int. Cl.
*G10L 19/00* (2013.01)

(52) U.S. Cl.
USPC ..... 704/201; 704/200; 704/500

(58) Field of Classification Search
USPC ..... 704/200–201, 500–502
See application file for complete search history.

(56) References Cited

U.S. PATENT DOCUMENTS

| | | | | |
|---|---|---|---|---|
| 5,970,443 | A * | 10/1999 | Fujii | 704/222 |
| 6,263,312 | B1 * | 7/2001 | Kolesnik et al. | 704/500 |
| 6,529,604 | B1 | 3/2003 | Park et al. | |
| 6,662,154 | B2 * | 12/2003 | Mittal et al. | 704/219 |
| 7,260,522 | B2 | 8/2007 | Gao et al. | |
| 7,277,849 | B2 * | 10/2007 | Streich et al. | 704/229 |
| 7,461,106 | B2 | 12/2008 | Mittal et al. | |
| 7,693,707 | B2 * | 4/2010 | Yamanashi et al. | 704/200.1 |
| 2003/0110027 | A1 * | 6/2003 | Mittal et al. | 704/219 |
| 2003/0220783 | A1 * | 11/2003 | Streich et al. | 704/200.1 |
| 2007/0258518 | A1 * | 11/2007 | Tu et al. | 375/240.03 |

(Continued)

FOREIGN PATENT DOCUMENTS

| | | | |
|---|---|---|---|
| EP | 1750254 | A1 | 2/2007 |
| EP | 1806736 | A1 | 7/2007 |

(Continued)

OTHER PUBLICATIONS

3GPP2 C.S0014-C, Version 1.0. "Enhanced Variable Rate Codec, Speech Service Options 3, 68, and 70 for Wideband Spread Spectrum Digital Systems," Jan. 2007, XP002510839.

(Continued)

*Primary Examiner* — Douglas Godbold
(74) *Attorney, Agent, or Firm* — Espartaco Diaz Hidalgo

(57) ABSTRACT

A scalable speech and audio codec is provided that implements combinatorial spectrum encoding. A residual signal is obtained from a Code Excited Linear Prediction (CELP)-based encoding layer, where the residual signal is a difference between an original audio signal and a reconstructed version of the original audio signal. The residual signal is transformed at a Discrete Cosine Transform (DCT)-type transform layer to obtain a corresponding transform spectrum having a plurality of spectral lines. The transform spectrum spectral lines are transformed using a combinatorial position coding technique. The combinatorial position coding technique includes generating a lexicographical index for a selected subset of spectral lines, where each lexicographic index represents one of a plurality of possible binary strings representing the positions of the selected subset of spectral lines. The lexicographical index represents non-zero spectral lines in a binary string in fewer bits than the length of the binary string.

41 Claims, 13 Drawing Sheets

(56) References Cited

U.S. PATENT DOCUMENTS

| | | | | |
|---|---|---|---|---|
| 2008/0065374 | A1* | 3/2008 | Mittal et al. | 704/212 |
| 2008/0312914 | A1 | 12/2008 | Rajendran et al. | |
| 2009/0094024 | A1 | 4/2009 | Yamanashi et al. | |

FOREIGN PATENT DOCUMENTS

| | | | |
|---|---|---|---|
| KR | 20070061818 | A | 6/2007 |
| RU | 2197776 | C2 | 1/2003 |
| RU | 2262748 | C2 | 10/2005 |
| TW | 347623 | | 12/1998 |
| TW | 378478 | | 1/2000 |
| TW | 490980 | B | 6/2002 |
| WO | WO2006082790 | A1 | 8/2006 |
| WO | WO2007105586 | A1 | 9/2007 |

OTHER PUBLICATIONS

Ashley, J.P., et al., "Wideband Coding of Speech Using a Scalable Pulse Codebook," 2000 IEEE Workshop on Speech Coding, 2000, Sep. 17-20, 2000, pp. 148-150.

B. Ya. Ryabko, The fast enumeration of combinatorial objects, Discrete Math.and Applications, 10, (2), 1998.

"Extended high-level description of the Q9 EV-VBR baseline codec", ITU Study Group 16, Question 9/16, Contribution 199, Jun. 2005.

International Search Report—PCT/US08/080824, International Search Authority—European Patent Office, Feb. 5, 2009.

"Low complexity factorial pulse coding of MDCT coefficients using approximation of combinatorial functions" 2007 IEEE Nternational Conference on Acoustics, Speech, and Signal Processing Apr. 15-20, 2007 Honolulu, HI, USA, Apr. 15, 2007, pp. I-289, XP002510838 ISBN: 1-4244-0727-3.

Masahiro Oshikiri, Hiroyuki Ehara, Toshiyuki Morii, Tomofumi Yamanashi, Kaoru Satoh, and Koji Yoshida, "An 8-32 kbit/s Scalable Wideband Coder Extended with MDCT-based Bandwidth Extension on top of a 6.8 kbit/s Narrowband CELP Coder", Interspeech 2007.

Mudrov, An algorithm for enumeration of combinations, Vyc. Math. and Math. Phys., 5 (4) (1965) 776-778.

Schalkwijk, J. Pieter M., "An Algorithm for Source Coding", IEEE Trans. Inf. Theory, 18 (3) (1972) pp. 395-399.

T. M. Cover, Enumerative Sources Encoding, IEEE Trans. Inf. Theory, 19 (1) (1973) 73-77.

Written Opinion—PCT/US08/080824, International Search Authority—European Patent Office, Feb. 5, 2009.

Ragot, S. et al. "ITU-T G.729.1: AN 8-32 Kbit/S Scalable Coder Interoperable with G.729 for Wideband Telephony and Voice Over IP," Acoustics, Speech and Signal Processing, 2007, ICASSP 2007. IEEE International Conference on, pp. IV-529-IV-523, 15-20.

Yang, J. et al. "Transform-Based CELP Vocoders with Low-Delay Low-Complexity and Variable-Rate Features," IEICE Transactions on Information and Systems e Series d, vol. E85D, No. 6, pp. 1003-1014, Jun. 2002.

Taiwan Search Report—TW097140565—TIPO—Jan. 23, 2013.

* cited by examiner

LOW-COMPLEXITY ENCODING/DECODING OF QUANTIZED MDCT SPECTRUM IN SCALABLE SPEECH AND AUDIO CODECS

CLAIM OF PRIORITY UNDER 35 U.S.C. §119

The present application for patent claims priority to U.S. Provisional Application No. 60/981,814 entitled "Low-Complexity Technique for Encoding/Decoding of Quantized MDCT Spectrum in Scalable Speech+Audio Codecs" filed Oct. 22, 2007, and assigned to the assignee hereof and hereby expressly incorporated by reference herein.

BACKGROUND

1. Field

The following description generally relates to encoders and decoders and, in particular, to an efficient way of coding modified discrete cosine transform (MDCT) spectrum as part of a scalable speech and audio codec.

2. Background

One goal of audio coding is to compress an audio signal into a desired limited information quantity while keeping as much as the original sound quality as possible. In an encoding process, an audio signal in a time domain is transformed into a frequency domain.

Perceptual audio coding techniques, such as MPEG Layer-3 (MP3), MPEG-2 and MPEG-4, make use of the signal masking properties of the human ear in order to reduce the amount of data. By doing so, the quantization noise is distributed to frequency bands in such a way that it is masked by the dominant total signal, i.e. it remains inaudible. Considerable storage size reduction is possible with little or no perceptible loss of audio quality. Perceptual audio coding techniques are often scalable and produce a layered bit stream having a base or core layer and at least one enhancement layer. This allows bit-rate scalability, i.e. decoding at different audio quality levels at the decoder side or reducing the bit rate in the network by traffic shaping or conditioning.

Code excited linear prediction (CELP) is a class of algorithms, including algebraic CELP (ACELP), relaxed CELP (RCELP), low-delay (LD-CELP) and vector sum excited linear predication (VSELP), that is widely used for speech coding. One principle behind CELP is called Analysis-by-Synthesis (AbS) and means that the encoding (analysis) is performed by perceptually optimizing the decoded (synthesis) signal in a closed loop. In theory, the best CELP stream would be produced by trying all possible bit combinations and selecting the one that produces the best-sounding decoded signal. This is obviously not possible in practice for two reasons: it would be very complicated to implement and the "best sounding" selection criterion implies a human listener. In order to achieve real-time encoding using limited computing resources, the CELP search is broken down into smaller, more manageable, sequential searches using a perceptual weighting function. Typically, the encoding includes (a) computing and/or quantizing (usually as line spectral pairs) linear predictive coding coefficients for an input audio signal, (b) using codebooks to search for a best match to generate a coded signal, (c) producing an error signal which is the difference between the coded signal and the real input signal, and (d) further encoding such error signal (usually in an MDCT spectrum) in one or more layers to improve the quality of a reconstructed or synthesized signal.

Many different techniques are available to implement speech and audio codecs based on CELP algorithms. In some of these techniques, an error signal is generated which is subsequently transformed (usually using a DCT, MDCT, or similar transform) and encoded to further improve the quality of the encoded signal. However, due to the processing and bandwidth limitations of many mobile devices and networks, efficient implementation of such MDCT spectrum coding is desirable to reduce the size of information being stored or transmitted.

SUMMARY

The following presents a simplified summary of one or more embodiments in order to provide a basic understanding of some embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

An efficient technique for encoding/decoding of MDCT (or similar transform-based) spectrum in scalable speech and audio compression algorithms is provided. This technique utilizes the sparseness property of perceptually-quantized MDCT spectrum in defining the structure of the code, which includes an element describing positions of non-zero spectral lines in a coded band, and uses combinatorial enumeration techniques to compute this element.

In one example, a method for encoding an MDCT spectrum in a scalable speech and audio codec is provided. Such encoding of a transform spectrum may be performed by encoder hardware, encoding software, and/or a combination of the two, and may be embodied in a processor, processing circuit, and/or machine readable-medium. A residual signal is obtained from a Code Excited Linear Prediction (CELP)-based encoding layer, where the residual signal is a difference between an original audio signal and a reconstructed version of the original audio signal. The reconstructed version of the original audio signal may be obtained by: (a) synthesizing an encoded version of the original audio signal from the CELP-based encoding layer to obtain a synthesized signal, (b) re-emphasizing the synthesized signal, and/or (c) up-sampling the re-emphasized signal to obtain the reconstructed version of the original audio signal.

The residual signal is transformed at a Discrete Cosine Transform (DCT)-type transform layer to obtain a corresponding transform spectrum having a plurality of spectral lines. The DCT-type transform layer may be a Modified Discrete Cosine Transform (MDCT) layer and the transform spectrum is an MDCT spectrum.

The transform spectrum spectral lines are encoded using a combinatorial position coding technique. Encoding of the transform spectrum spectral lines may include encoding positions of a selected subset of spectral lines based on representing spectral line positions using the combinatorial position coding technique for non-zero spectral lines positions. In some implementations, a set of spectral lines may be dropped to reduce the number of spectral lines prior to encoding. In another example, the combinatorial position coding technique may include generating a lexicographical index for a selected subset of spectral lines, where each lexicographic index represents one of a plurality of possible binary strings representing the positions of the selected subset of spectral lines. The lexicographical index may represent spectral lines in binary string in fewer bits than the length of the binary string.

In another example, the combinatorial position coding technique may include generating an index representative of positions of spectral lines within a binary string, the positions of the spectral lines being encoded based a combinatorial formula:

$$\text{index}(n, k, w) = i(w) = \sum_{j=1}^{n} w_j \binom{n-j}{\sum_{i=j}^{n} w_i}$$

where n is the length of the binary string, k is the number of selected spectral lines to be encoded, and $w_j$ represents individual bits of the binary string.

In some implementations, the plurality of spectral lines may be split into a plurality of sub-bands and consecutive sub-bands may be grouped into regions. A main pulse selected from a plurality of spectral lines for each of the sub-bands in the region may be encoded, where the selected subset of spectral lines in the region excludes the main pulse for each of the sub-bands. Additionally, positions of a selected subset of spectral lines within a region may be encoded based on representing spectral line positions using the combinatorial position coding technique for non-zero spectral lines positions. The selected subset of spectral lines in the region may exclude the main pulse for each of the sub-bands. Encoding of the transform spectrum spectral lines may include generating an array, based on the positions of the selected subset of spectral lines, of all possible binary strings of length equal to all positions in the region. The regions may be overlapping and each region may include a plurality of consecutive sub-bands.

In another example, a method for decoding a transform spectrum in a scalable speech and audio codec is provided. Such decoding of a transform spectrum may be performed by decoder hardware, decoding software, and/or a combination of the two, and may be embodied in a processor, processing circuit, and/or machine readable-medium. An index representing a plurality of transform spectrum spectral lines of a residual signal is obtained, where the residual signal is a difference between an original audio signal and a reconstructed version of the original audio signal from a Code Excited Linear Prediction (CELP)-based encoding layer. The index may represent non-zero spectral lines in a binary string in fewer bits than the length of the binary string. In one example, the obtained index may represent positions of spectral lines within a binary string, the positions of the spectral lines being encoded based a combinatorial formula:

$$\text{index}(n, k, w) = i(w) = \sum_{j=1}^{n} w_j \binom{n-j}{\sum_{i=j}^{n} w_i}$$

where n is the length of the binary string, k is the number of selected spectral lines to be encoded, and $w_j$ represents individual bits of the binary string.

The index is decoded by reversing a combinatorial position coding technique used to encode the plurality of transform spectrum spectral lines. A version of the residual signal is synthesized using the decoded plurality of transform spectrum spectral lines at an Inverse Discrete Cosine Transform (IDCT)-type inverse transform layer. Synthesizing a version of the residual signal may include applying an inverse DCT-type transform to the transform spectrum spectral lines to produce a time-domain version of the residual signal. Decoding the transform spectrum spectral lines may include decoding positions of a selected subset of spectral lines based on representing spectral line positions using the combinatorial position coding technique for non-zero spectral lines positions. The DCT-type inverse transform layer may be an Inverse Modified Discrete Cosine Transform (IMDCT) layer and the transform spectrum is an MDCT spectrum.

Additionally a CELP-encoded signal encoding the original audio signal may be received. The CELP-encoded signal may be decoded to generate a decoded signal. The decoded signal may be combined with the synthesized version of the residual signal to obtain a (higher-fidelity) reconstructed version of the original audio signal.

BRIEF DESCRIPTION OF THE DRAWINGS

Various features, nature, and advantages may become apparent from the detailed description set forth below when taken in conjunction with the drawings in which like reference characters identify correspondingly throughout.

DETAILED DESCRIPTION

Figure 1:
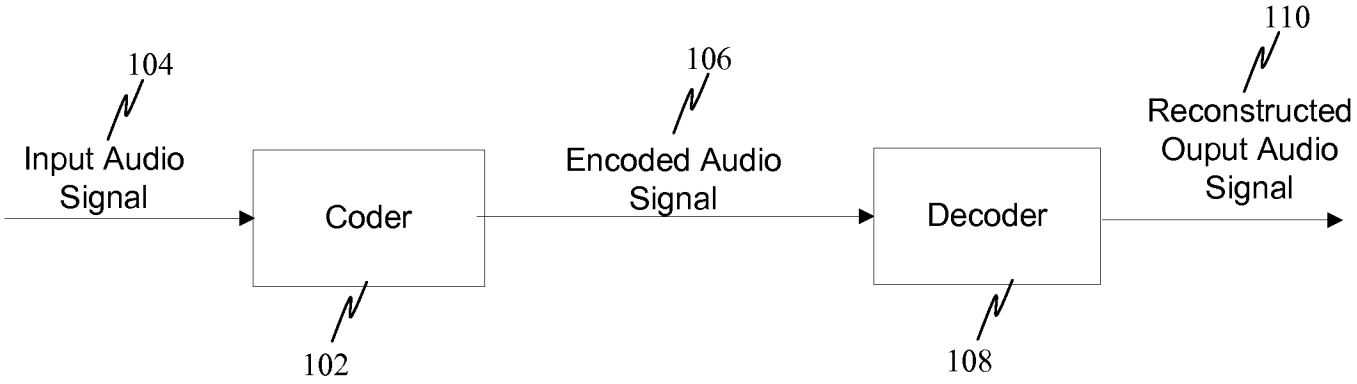
FIG. 1 is a block diagram illustrating a communication system in which one or more coding features may be implemented.

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiment(s) may be practiced without these specific details. In other instances, well-known structures and devices are shown in block diagram form in order to facilitate describing one or more embodiments.

Overview

In a scalable codec for encoding/decoding audio signals in which multiple layers of coding are used to iteratively encode an audio signal, a Modified Discrete Cosine Transform may be used in one or more coding layers where audio signal residuals are transformed (e.g., into an MDCT domain) for encoding. In the MDCT domain, a frame of spectral lines may be divided into sub-bands and regions of overlapping sub-bands are defined. For each sub-band in a region, a main pulse (i.e., strongest spectral line or group of spectral lines in the sub-band) may be selected. The position of the main pulses may be encoded using an integer to represent its position within each of their sub-bands. The amplitude/magnitude of each of the main pulses may be separately encoded. Additionally, a plurality (e.g., four) of sub-pulses (e.g., remaining spectral lines) in the region are selected, excluding the already selected main pulses. The selected sub-pulses are encoded based on their overall position within the region. The positions of these sub-pulses may be encoded using a combinatorial position coding technique to produce lexicographical indexes that can be represented in fewer bits than the over all length of the region. By representing main pulses and sub-pulses in this manner, they can be encoded using a relatively small number of bits for storage and/or transmission.

Communication System

FIG. 1 is a block diagram illustrating a communication system in which one or more coding features may be implemented. A coder 102 receives an incoming input audio signal 104 and generates and encoded audio signal 106. The encoded audio signal 106 may be transmitted over a transmission channel (e.g., wireless or wired) to a decoder 108. The decoder 108 attempts to reconstructs the input audio signal 104 based on the encoded audio signal 106 to generate a reconstructed output audio signal 110. For purposes of illustration, the coder 102 may operate on a transmitter device while the decoder device may operate on receiving device. However, it should be clear that any such devices may include both an encoder and decoder.

Figure 2:
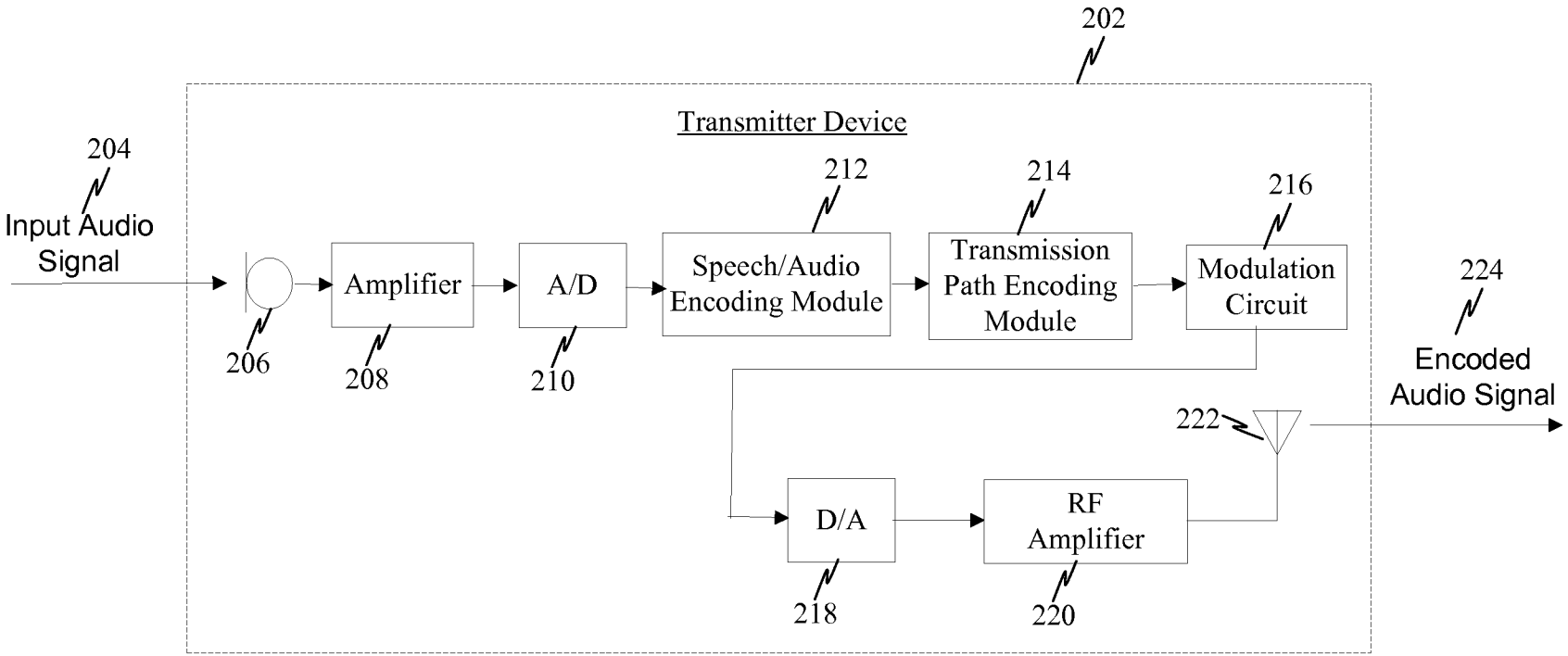
FIG. 2 is a block diagram illustrating a transmitting device that may be configured to perform efficient audio coding according to one example.

FIG. 2 is a block diagram illustrating a transmitting device 202 that may be configured to perform efficient audio coding according to one example. An input audio signal 204 is captured by a microphone 206, amplified by an amplifier 208, and converted by an A/D converter 210 into a digital signal which is sent to a speech encoding module 212. The speech encoding module 212 is configured to perform multi-layered (scaled) coding of the input signal, where at least one such layer involves encoding a residual (error signal) in an MDCT spectrum. The speech encoding module 212 may perform encoding as explained in connection with FIGS. 4, 5, 6, 7, 8, 9 and 10. Output signals from the speech encoding module 212 may be sent to a transmission path encoding module 214 where channel decoding is performed and the resulting output signals are sent to a modulation circuit 216 and modulated so as to be sent via a D/A converter 218 and an RF amplifier 220 to an antenna 222 for transmission of an encoded audio signal 224.

Figure 3:
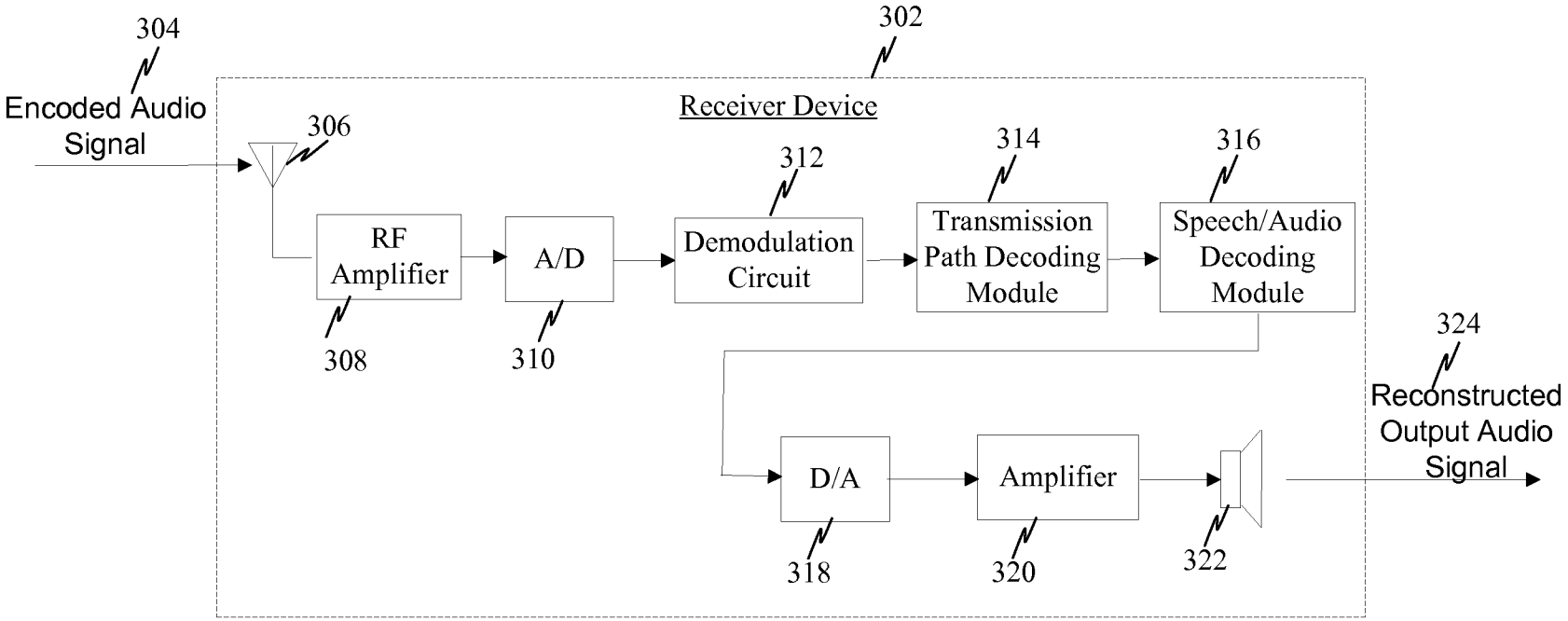
FIG. 3 is a block diagram illustrating a receiving device that may be configured to perform efficient audio decoding according to one example.

FIG. 3 is a block diagram illustrating a receiving device 302 that may be configured to perform efficient audio decoding according to one example. An encoded audio signal 304 is received by an antenna 306 and amplified by an RF amplifier 308 and sent via an A/D converter 310 to a demodulation circuit 312 so that demodulated signals are supplied to a transmission path decoding module 314. An output signal from the transmission path decoding module 314 is sent to a speech decoding module 316 configured to perform multi-layered (scaled) decoding of the input signal, where at least one such layer involves decoding a residual (error signal) in an IMDCT spectrum. The speech decoding module 316 may perform signal decoding as explained in connection with FIGS. 11, 12, and 13. Output signals from the speech decoding module 316 are sent to a D/A converter 318. An analog speech signal from the D/A converter 318 is the sent via an amplifier 320 to a speaker 322 to provide a reconstructed output audio signal 324.

Scalable Audio Codec Architecture

The coder 102 (FIG. 1), decoder 108 (FIG. 1), speech/audio encoding module 212 (FIG. 2), and/or speech/audio decoding module 316 (FIG. 3) may be implemented as a scalable audio codec. Such scalable audio codec may be implemented to provide high-performance wideband speech coding for error prone telecommunications channels, with high quality of delivered encoded narrowband speech signals or wideband audio/music signals. One approach to a scalable audio codec is to provide iterative encoding layers where the error signal (residual) from one layer is encoded in a subsequent layer to further improve the audio signal encoded in previous layers. For instance, Codebook Excited Linear Prediction (CELP) is based on the concept of linear predictive coding in which a codebook of different excitation signals is maintained on the encoder and decoder. The encoder finds the most suitable excitation signal and sends its corresponding index (from a fixed, algebraic, and/or adaptive codebook) to the decoder which then uses it to reproduce the signal (based on the codebook). The encoder performs analysis-by-synthesis by encoding and then decoding the audio signal to produce a reconstructed or synthesized audio signal. The encoder then finds the parameters that minimize the energy of the error signal, i.e., the difference between the original audio signal and a reconstructed or synthesized audio signal. The output bit-rate can be adjusted by using more or less coding layers to meet channel requirements and a desired audio quality. Such scalable audio codec may include several layers where higher layer bitstreams can be discarded without affecting the decoding of the lower layers.

Examples of existing scalable codecs that use such multi-layer architecture include the ITU-T Recommendation G.729.1 and an emerging ITU-T standard, code-named G.EV-VBR. For example, an Embedded Variable Bit Rate (EV-VBR) codec may be implemented as multiple layers L1 (core layer) through LX (where X is the number of the highest extension layer). Such codec may accept both wideband (WB) signals sampled at 16 kHz, and narrowband (NB) signals sampled at 8 kHz. Similarly, the codec output can be wideband or narrowband.

An example of the layer structure for a codec (e.g., EV-VBR codec) is shown in Table 1, comprising five layers; referred to as L1 (core layer) through L5 (the highest extension layer). The lower two layers (L1 and L2) may be based on a Code Excited Linear Prediction (CELP) algorithm. The core layer L1 may be derived from a variable multi-rate wideband (VMR-WB) speech coding algorithm and may comprise several coding modes optimized for different input signals. That is, the core layer L1 may classify the input signals to better model the audio signal. The coding error (residual) from the core layer L1 is encoded by the enhancement or extension layer L2, based on an adaptive codebook and a fixed algebraic codebook. The error signal (residual) from layer L2 may be further coded by higher layers (L3-L5) in a transform domain using a modified discrete cosine transform (MDCT). Side information may be sent in layer L3 to enhance frame erasure concealment (FEC).

TABLE 1

| Layer | Bitrate kbit/s | Technique | | Sampling rate kHz | |
|---|---|---|---|---|---|
| L1 | 8 | CELP core layer (classification) | | 12.8 | |
| L2 | +4 | Algebraic codebook layer (enhancement) | | 12.8 | |
| L3 | +4 | FEC | MDCT | 12.8 | 16 |
| L4 | +8 | MDCT | | 16 | |
| L5 | +8 | MDCT | | 16 | |

The core layer L1 codec is essentially a CELP-based codec, and may be compatible with one of a number of well-known narrow-band or wideband vocoders such as Adaptive Multi-Rate (AMR), AMR Wideband (AMR-WB), Variable Multi-Rate Wideband (VMR-WB), Enhanced Variable Rate codec (EVRC), or EVR Wideband (EVRC-WB) codecs.

Layer 2 in a scalable codec may use codebooks to further minimize the perceptually weighted coding error (residual) from the core layer L1. To enhance the codec frame erasure concealment (FEC), side information may be computed and transmitted in a subsequent layer L3. Independently of the core layer coding mode, the side information may include signal classification.

It is assumed that for wideband output, the weighted error signal after layer L2 encoding is coded using an overlap-add transform coding based on the modified discrete cosine transform (MDCT) or similar type of transform. That is, for coded layers L3, L4, and/or L5, the signal may be encoded in the MDCT spectrum. Consequently, an efficient way of coding the signal in the MDCT spectrum is provided.

Encoder Example

Figure 4:
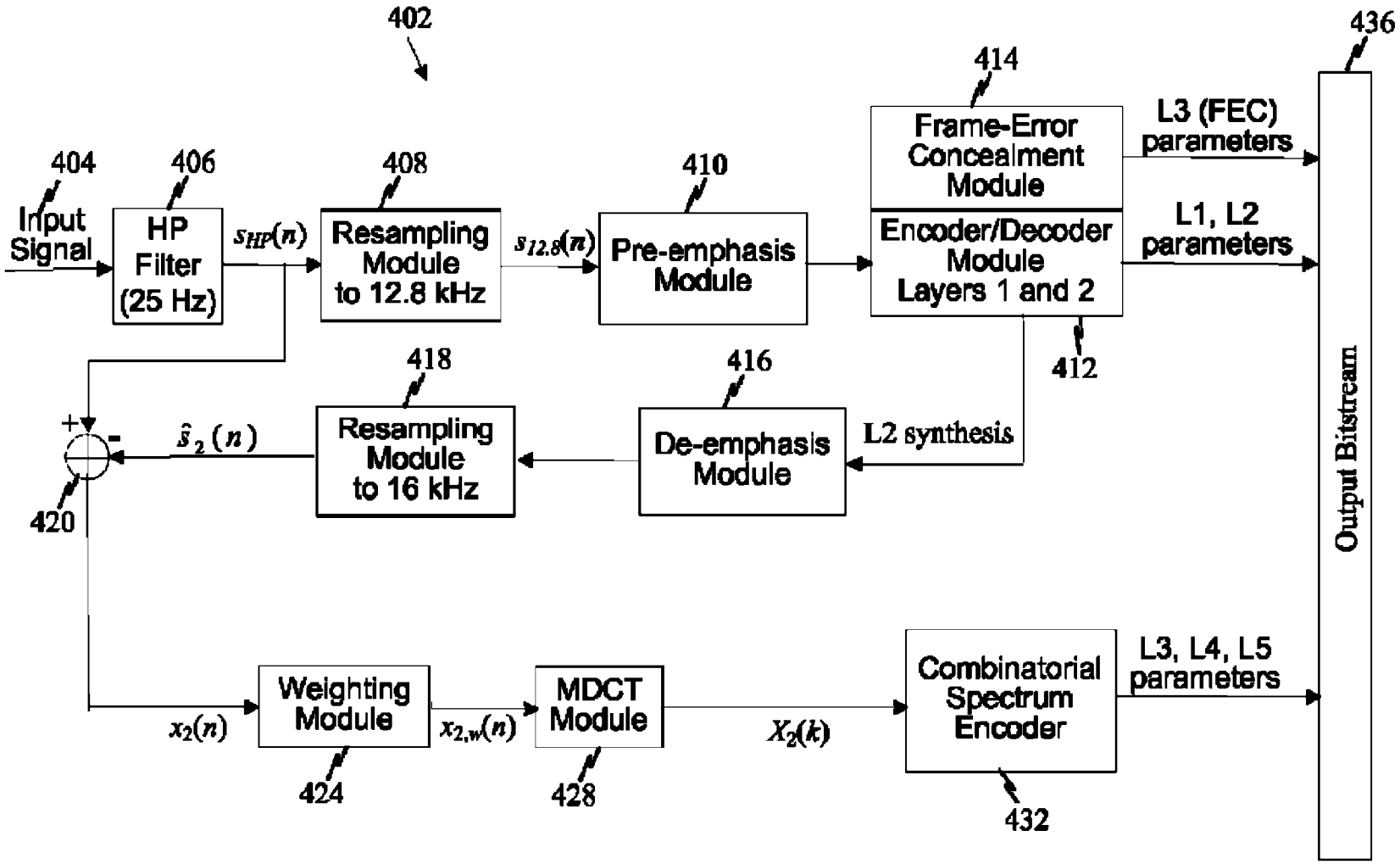
FIG. 4 is a block diagram of a scalable encoder according to one example.

FIG. 4 is a block diagram of a scalable encoder 402 according to one example. In a pre-processing stage prior to encoding, an input signal 404 is high-pass filtered 406 to suppress undesired low frequency components to produce a filtered input signal $S_{HP}(n)$. For example, the high-pass filter 406 may have a 25 Hz cutoff for a wideband input signal and 100 Hz for a narrowband input signal. The filtered input signal $S_{HP}(n)$ is then resampled by a resampling module 408 to produce a resampled input signal $S_{12.8}(n)$. For example, the original input signal 404 may be sampled at 16 kHz and is resampled to 12.8 kHz which may be an internal frequency used for layer L1 and/or L2 encoding. A pre-emphasis module 410 then applies a first-order high-pass filter to emphasize higher frequencies (and attenuate low frequencies) of the resampled input signal $S_{12.8}(n)$. The resulting signal then passes to an encoder/decoder module 412 that may perform layer L1 and/or L2 encoding based on a Code-Excited Linear Prediction (CELP)-based algorithm where the speech signal is modeled by an excitation signal passed through a linear prediction (LP) synthesis filter representing the spectral envelope. The signal energy may be computed for each perceptual critical band and used as part of layers L1 and L2 encoding. Additionally, the encoded encoder/decoder module 412 may also synthesize (reconstruct) a version of the input signal. That is, after the encoder/decoder module 412 encodes the input signal, it decodes it and a de-emphasis module 416 and a resampling module 418 recreate a version $\hat{s}_2(n)$ of the input signal 404. A residual signal $x_2(n)$ is generated by taking the difference 420 between the original signal $S_{HP}(n)$ and the recreated signal $\hat{s}_2(n)$ (i.e., $x_2(n)=S_{HP}(n)-\hat{s}_2(n)$). The residual signal $x_2(n)$ is then perceptually weighted by weighting module 424 and transformed by an MDCT module 428 into the MDCT spectrum or domain to generate a residual signal $X_2(k)$. The residual signal $X_2(k)$ is then provided to a combinatorial spectrum encoder 432 that encodes the residual signal $X_2(k)$ to produce encoded parameters for layers L3, L4, and/or L5. In one example, the combinatorial spectrum encoder 432 generates an index representing non-zero spectral lines (pulses) in the residual signal $X_2(k)$. For example, the index may represent one of a plurality of possible binary strings representing the positions of non-zero spectral lines. Due to the combinatorial technique, the index may represent non-zero spectral lines in a binary string in fewer bits than the length of the binary string.

The parameters from layers L1 to L5 can then serve as an output bitstream 436 and can be subsequently be used to reconstruct or synthesize a version of the original input signal 404 at a decoder.

Layer 1—Classification Encoding:

The core layer L1 may be implemented at the encoder/decoder module 412 and may use signal classification and four distinct coding modes to improve encoding performance. In one example, these four distinct signal classes that can be considered for different encoding of each frame may include: (1) unvoiced coding (UC) for unvoiced speech frames, (2) voiced coding (VC) optimized for quasi-periodic segments with smooth pitch evolution, (3) transition mode (TC) for frames following voiced onsets designed to minimize error propagation in case of frame erasures, and (4) generic coding (GC) for other frames. In Unvoiced coding (UC), an adaptive codebook is not used and the excitation is selected from a Gaussian codebook. Quasi-periodic segments are encoded with Voiced coding (VC) mode. Voiced coding selection is conditioned by a smooth pitch evolution. The Voiced coding mode may use ACELP technology. In Transition coding (TC) frame, the adaptive codebook in the subframe containing the glottal impulse of the first pitch period is replaced with a fixed codebook.

In the core layer L1, the signal may be modeled using a CELP-based paradigm by an excitation signal passing through a linear prediction (LP) synthesis filter representing the spectral envelope. The LP filter may be quantized in the Immitance spectral frequency (ISF) domain using a Safety-Net approach and a multi-stage vector quantization (MSVQ) for the generic and voiced coding modes. An open-loop (OL) pitch analysis is performed by a pitch-tracking algorithm to ensure a smooth pitch contour. However, in order to enhance the robustness of the pitch estimation, two concurrent pitch evolution contours may be compared and the track that yields the smoother contour is selected.

Two sets of LPC parameters are estimated and encoded per frame in most modes using a 20 ms analysis window, one for the frame-end and one for the mid-frame. Mid-frame ISFs are encoded with an interpolative split VQ with a linear interpolation coefficient being found for each ISF sub-group, so that the difference between the estimated and the interpolated quantized ISFs is minimized. In one example, to quantize the ISF representation of the LP coefficients, two codebook sets (corresponding to weak and strong prediction) may be searched in parallel to find the predictor and the codebook entry that minimize the distortion of the estimated spectral envelope. The main reason for this Safety-Net approach is to reduce the error propagation when frame erasures coincide with segments where the spectral envelope is evolving rapidly. To provide additional error robustness, the weak predictor is sometimes set to zero which results in quantization without prediction. The path without prediction may always be chosen when its quantization distortion is sufficiently close to the one with prediction, or when its quantization distortion is small enough to provide transparent coding. In addition, in strongly-predictive codebook search, a sub-optimal code vector is chosen if this does not affect the clean-channel performance but is expected to decrease the error propagation in the presence of frame-erasures. The ISFs of UC and TC frames are further systematically quantized without prediction. For UC frames, sufficient bits are available to allow for very good spectral quantization even without prediction. TC frames are considered too sensitive to frame erasures for prediction to be used, despite a potential reduction in clean channel performance.

For narrowband (NB) signals, the pitch estimation is performed using the L2 excitation generated with unquantized optimal gains. This approach removes the effects of gain quantization and improves pitch-lag estimate across the layers. For wideband (WB) signals, standard pitch estimation (L1 excitation with quantized gains) is used.

Layer 2—Enhancement Encoding:

In layer L2, the encoder/decoder module 412 may encode the quantization error from the core layer L1 using again the algebraic codebooks. In the L2 layer, the encoder further modifies the adaptive codebook to include not only the past L1 contribution, but also the past L2 contribution. The adaptive pitch-lag is the same in L1 and L2 to maintain time synchronization between the layers. The adaptive and algebraic codebook gains corresponding to L1 and L2 are then re-optimized to minimize the perceptually weighted coding error. The updated L1 gains and the L2 gains are predictively vector-quantized with respect to the gains already quantized in L1. The CELP layers (L1 and L2) may operate at internal (e.g. 12.8 kHz) sampling rate. The output from layer L2 thus includes a synthesized signal encoded in the 0-6.4 kHz frequency band. For wideband output, the AMR-WB bandwidth extension may be used to generate the missing 6.4-7 kHz bandwidth.

Layer 3—Frame Erasure Concealment:

To enhance the performance in frame erasure conditions (FEC), a frame-error concealment module 414 may obtain side information from the encoder/decoder module 412 and uses it to generate layer L3 parameters. The side information may include class information for all coding modes. Previous frame spectral envelope information may be also transmitted for core layer Transition coding. For other core layer coding modes, phase information and the pitch-synchronous energy of the synthesized signal may also be sent.

Layers 3, 4, 5—Transform Coding:

The residual signal $X_2(k)$ resulting from the second stage CELP coding in layer L2 may be quantized in layers L3, L4 and L5 using an MDCT or similar transform with overlap add structure. That is, the residual or "error" signal from a previous layer is used by a subsequent layer to generate its parameters (which seek to efficiently represent such error for transmission to a decoder).

The MDCT coefficients may be quantized by using several techniques. In some instances, the MDCT coefficients are quantized using scalable algebraic vector quantization. The MDCT may be computed every 20 milliseconds (ms), and its spectral coefficients are quantized in 8-dimensional blocks. An audio cleaner (MDCT domain noise-shaping filter) is applied, derived from the spectrum of the original signal. Global gains are transmitted in layer L3. Further, few bits are used for high frequency compensation. The remaining layer L3 bits are used for quantization of MDCT coefficients. The layer L4 and L5 bits are used such that the performance is maximized independently at layers L4 and L5 levels.

In some implementations, the MDCT coefficients may be quantized differently for speech and music dominant audio contents. The discrimination between speech and music contents is based on an assessment of the CELP model efficiency by comparing the L2 weighted synthesis MDCT components to the corresponding input signal components. For speech dominant content, scalable algebraic vector quantization (AVQ) is used in L3 and L4 with spectral coefficients quantized in 8-dimensional blocks. Global gain is transmitted in L3 and a few bits are used for high-frequency compensation. The remaining L3 and L4 bits are used for the quantization of the MDCT coefficients. The quantization method is the multi-rate lattice VQ (MRLVQ). A novel multi-level permutation-based algorithm has been used to reduce the complexity and memory cost of the indexing procedure. The rank computation is done in several steps: First, the input vector is decomposed into a sign vector and an absolute-value vector. Second, the absolute-value vector is further decomposed into several levels. The highest-level vector is the original absolute-value vector. Each lower-level vector is obtained by removing the most frequent element from the upper-level vector. The position parameter of each lower-level vector related to its upper-level vector is indexed based on a permutation and combination function. Finally, the index of all the lower-levels and the sign are composed into an output index.

For music dominant content, a band selective shape-gain vector quantization (shape-gain VQ) may be used in layer L3, and an additional pulse position vector quantizer may be applied to layer L4. In layer L3, band selection may be performed firstly by computing the energy of the MDCT coefficients. Then the MDCT coefficients in the selected band are quantized using a multi-pulse codebook. A vector quantizer is used to quantize sub-band gains for the MDCT coefficients. For layer L4, the entire bandwidth may be coded using a pulse positioning technique. In the event that the speech model produces unwanted noise due to audio source model mismatch, certain frequencies of the L2 layer output may be attenuated to allow the MDCT coefficients to be coded more aggressively. This is done in a closed loop manner by minimizing the squared error between the MDCT of the input signal and that of the coded audio signal through layer L4. The amount of attenuation applied may be up to 6 dB, which may be communicated by using 2 or fewer bits. Layer L5 may use additional pulse position coding technique.

Coding of MDCT Spectrum

Because layers L3, L4, and L5 perform coding in the MDCT spectrum (e.g., MDCT coefficients representing the residual for the previous layer), it is desirable for such MDCT spectrum coding to be efficient. Consequently, an efficient method of MDCT spectrum coding is provided.

The input to this process is either a complete MDCT spectrum of an error signal (residual) after CELP core (Layers L1 and/or L2) or a residual MDCT spectrum after previous a previous layer. That is, at layer L3, a complete MDCT spectrum is received and is partially encoded. Then at layer L4, the residual MDCT spectrum of the encoded signal at layer L3 is encoded. This process may be repeated for layer L5 and other subsequent layers.

Figure 5:
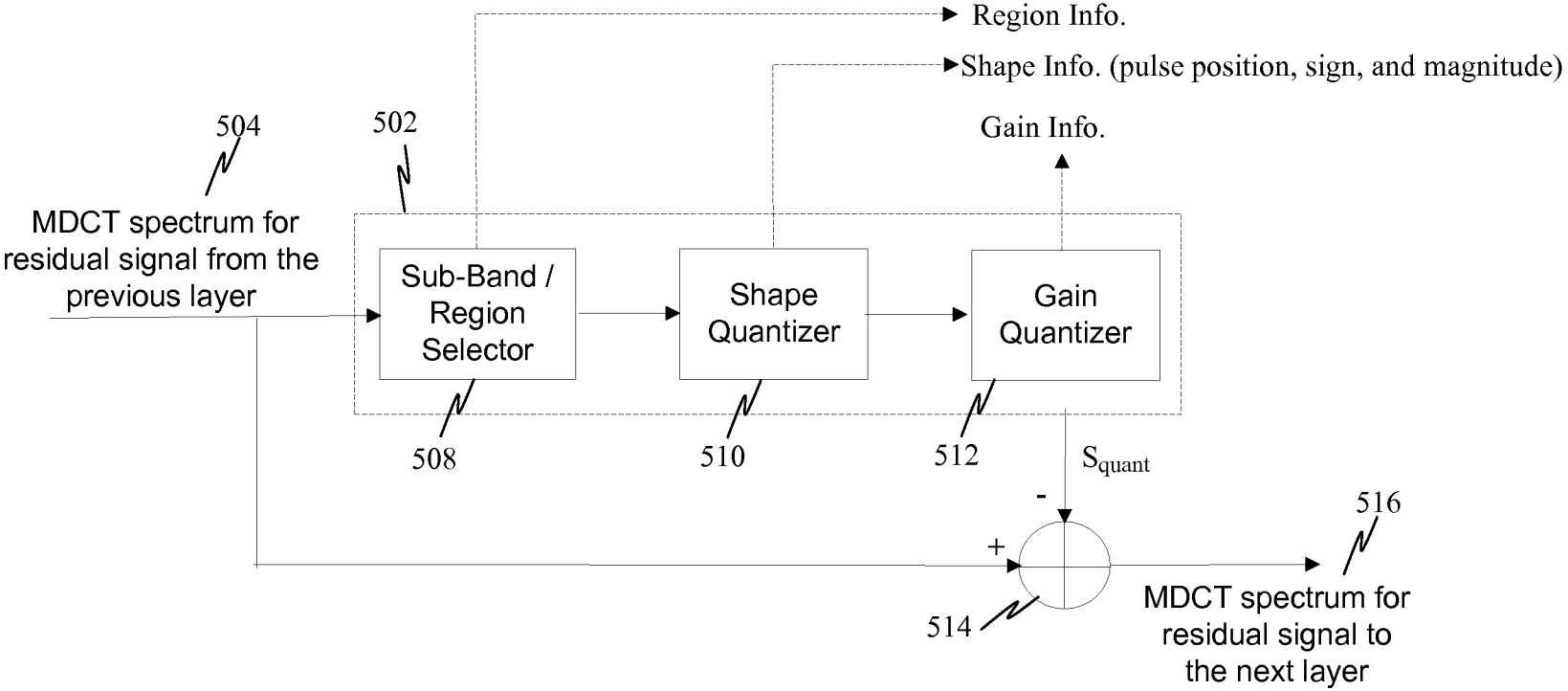
FIG. 5 is a block diagram illustrating an MDCT spectrum encoding process that may be implemented by an encoder.

FIG. 5 is a block diagram illustrating an example MDCT spectrum encoding process that may be implemented at higher layers of an encoder. The encoder 502 obtains the MDCT spectrum of a residual signal 504 from the previous layers. Such residual signal 504 may be the difference between an original signal and a reconstructed version of the original signal (e.g., reconstructed from an encoded version of the original signal). The MDCT coefficients of the residual signal may be quantized to generate spectral lines for a given audio frame.

In one example, a sub-band/region selector 508 may divide the residual signal 504 into a plurality (e.g., 17) of uniform sub-bands. For example, given an audio frame of three hundred twenty (320) spectral lines, the first and last twenty-four (24) points (spectral lines) may be dropped, and the remaining two hundred seventy-two (272) spectral lines may be divided into seventeen (17) sub-bands of sixteen (16) spectral lines each. It should be understood that in various implementations a different number of sub-bands may be used, the number of first and last points that may be dropped may vary, and/or the number of spectral lines that may be split per sub-band or frame may also vary.

Figure 6:
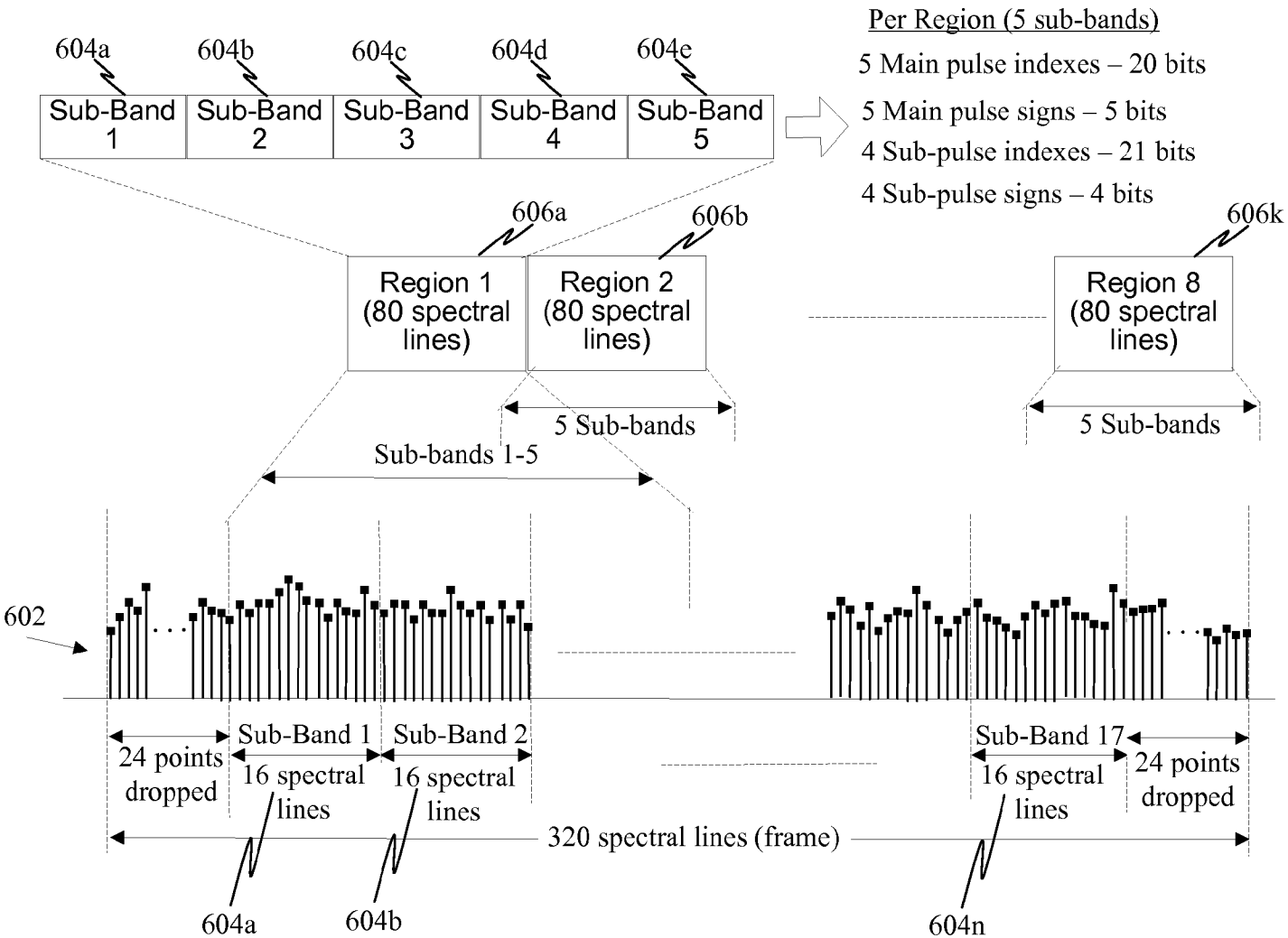
FIG. 6 is a diagram illustrating one example of how a frame may be selected and divided into regions and sub-bands to facilitate encoding of an MDCT spectrum.

FIG. 6 is a diagram illustrating one example of how an audio frame 602 may be selected and divided into regions and sub-bands to facilitate encoding of an MDCT spectrum. According to this example, a plurality of regions (e.g., 8) may be defined consisting of a plurality (e.g., 5) consecutive or contiguous sub-bands 604 (e.g., a region may cover 5 sub-bands*16 spectral lines/sub-band=80 spectral lines). The plurality of regions 606 may be arranged to overlapped with each neighboring region and to cover the full bandwidth (e.g., 7 kHz). Region information may be generated for encoding.

Once the region is selected, the MDCT spectrum in the region is quantized by a shape quantizer 510 and gain quantizer 512 using shape-gain quantization in which a shape (synonymous with position location and sign) and a gain of the target vector are sequentially quantized. Shaping may comprise forming a position location, a sign of the spectral lines corresponding to a main pulse and a plurality of sub-pulses per sub-band, along with a magnitude for the main pulses and sub-pulses. In the example illustrated in FIG. 6, eighty (80) spectral lines within a region 606 may be represented by a shape vector consisting of 5 main pulses (one main pulse for each of 5 consecutive sub-bands 604*a*, 604*b*, 604,*c*, 604*d*, and 604*e*) and 4 additional sub-pulses per region. That is, for each sub-band 604, a main pulse is selected (i.e., the strongest pulse within the 16 spectral lines in that sub-band). Additionally, for each region 606, an additional 4 sub-pulses (i.e., the next strongest spectral line pulses within the 80 spectral lines) are selected. As illustrated in FIG. 6, in one example the combination of the main pulse and sub-pulse positions and signs can be encoded with 50 bits, where:

- 20 bits for indexes for 5 main pulses (one main pulse per sub-band);
- 5 bits for signs of 5 main pulses;
- 21 bits for indexes of 4 sub-pulses anywhere within 80 spectral line region;
- 4 bits for signs of 4 sub-pulses.

Each main pulse may be represented by its position within a 16 spectral line sub-band using 4 bits (e.g., a number 0-16 represented by 4 bits). Consequently, for five (5) main pulses in a region, this takes 20 bits total. The sign of each main pulse and/or sub-pulse may be represented by one bit (e.g., either 0 or 1 for positive or negative). The position of each of the four (4) selected sub-pulses within a region may be encoded using a combinatorial position coding technique (using binomial coefficients to represent the position of each selected sub-pulse) to generate lexicographical indexes, such that a total of number of bits used to represent the position of the four sub-pulses within the region are less than the length of the region.

Note that additional bits may be utilized for encoding the amplitude and/or magnitude of the main pulses and/or sub-pulses. In some implementations, a pulse amplitude/magnitude may be encoded using two bits (i.e., 00—no pulse, 01—sub-pulse, and/or 10—main pulse). Following the shape quantization, a gain quantization is performed on calculated sub-band gains. Since the region contains 5 sub-bands, 5 gains are obtained for the region which can be vector quantized using 10 bits. The vector quantization exploits a switched prediction scheme. Note that an output residual signal 516 may be obtained (by subtracting 514 the quantized residual signal $S_{quant}$ from the original input residual signal 504) which can be used as the input for the next layer of encoding.

Figure 7:
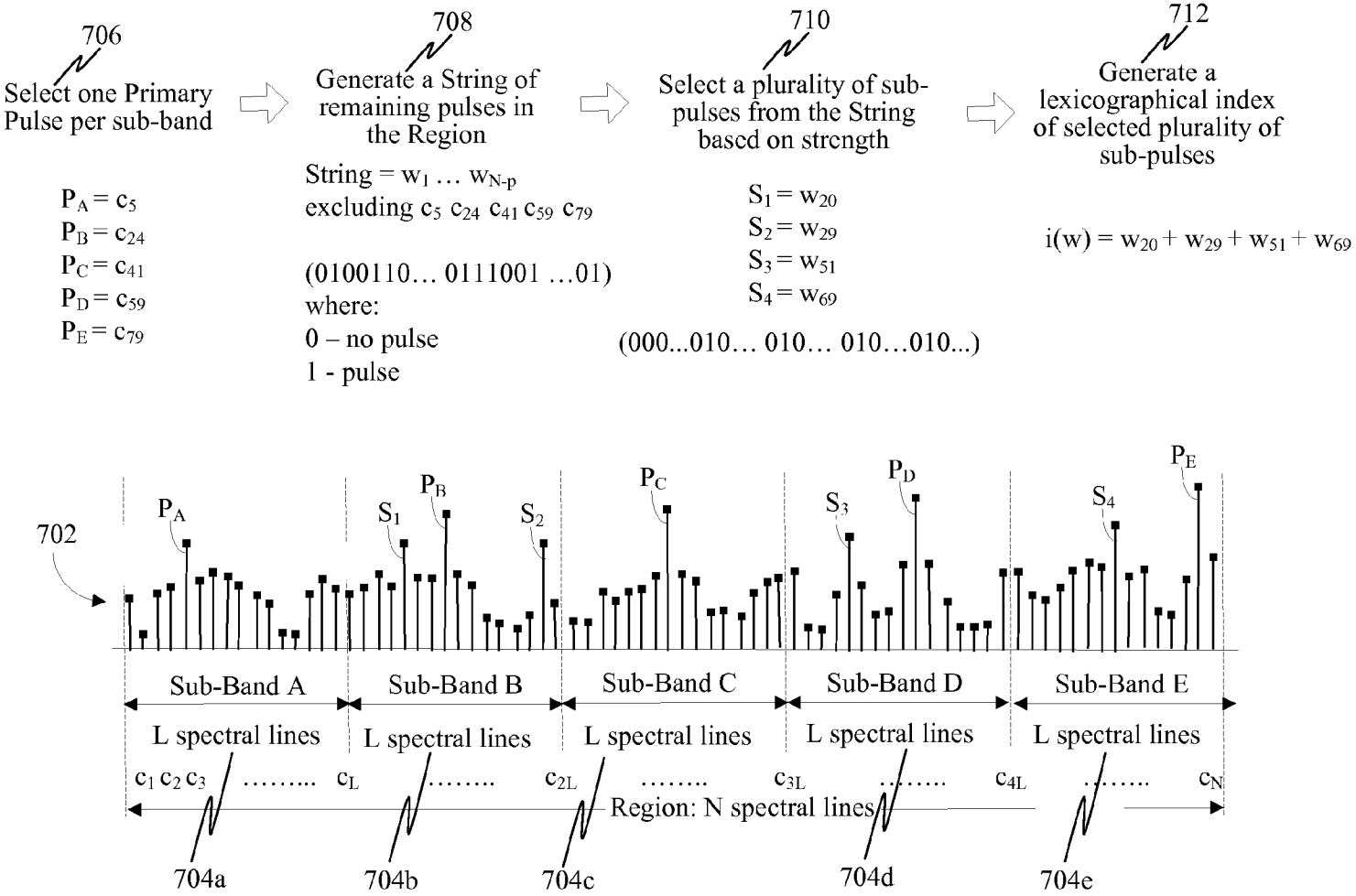
FIG. 7 illustrates a general approach for encoding an audio frame in an efficient manner.

FIG. 7 illustrates a general approach for encoding an audio frame in an efficient manner. A region 702 of N spectral lines may be defined from a plurality of consecutive or contiguous sub-bands, where each sub-band 704 has L spectral lines. The region 702 and/or sub-bands 704 may be for a residual signal of an audio frame.

For each sub-band, a main pulse is selected 706. For instance, the strongest pulse within the L spectral lines of a sub-band is selected as the main pulse for that sub-band. The strongest pulse may be selected as the pulse that has the greatest amplitude or magnitude in the sub-band. For example, a first main pulse $P_A$ is selected for Sub-Band A 704*a*, a second main pulse $P_B$ is selected for Sub-Band B 704*b*, and so on for each of the sub-bands 704. Note that since the region 702 has N spectral lines, the position of each spectral line within the region 702 can be denoted by $c_i$ (for $1 \leqq i \leqq N$). In one example, the first main pulse $P_A$ may be in position $c_3$, the second main pulse $P_B$ may be in position $c_{24}$, a third main pulse $P_C$ may be in position $c_{41}$, a fourth main pulse $P_D$ may be in position $c_{59}$, a fifth main pulse $P_E$ may be in position $c_{79}$. These main pulses may be encoded by using an integer to represent their position within its corresponding sub-band. Consequently, for L=16 spectral lines, the position of each main pulse may be represent by using four (4) bits.

A string w is generated from the remaining spectral lines or pulses in the region 708. To generate the string, the selected main pulses are removed from the string w, and the remaining pulses $w_1 \ldots w_{N-p}$ remain in the string (where p is the number of main pulses in the region). Note that the string may be represented by zeros "0" and "1", where "0" represents no pulse is present at a particular position and "1" represents a pulse is present at a particular position.

A plurality of sub-pulses is selected from the string w based on pulse strength 710. For instance, four (4) sub-pulses $S_1$, $S_2$, $S_3$, and $S_4$ may be selected based on their strength (amplitude/magnitude) (i.e., the strongest 4 pulses remaining in the string w are selected). In one example, a first sub-pulse $S_1$ may be in position $w_{20}$, a second sub-pulse $S_2$ may be in position $w_{29}$, a third sub-pulse $S_3$ may be in position $w_{51}$, and a fourth sub-pulse $S_4$ may be in position $w_{69}$. The position of each of the selected sub-pulses is then encoded using a lexicographic index 712 based on binomial coefficients so that the lexicographic index i(w) is based on the combination of selected sub-pulse positions, $i(w)=w_{20}+w_{29}+w_{51}+w_{69}$.

Figure 8:
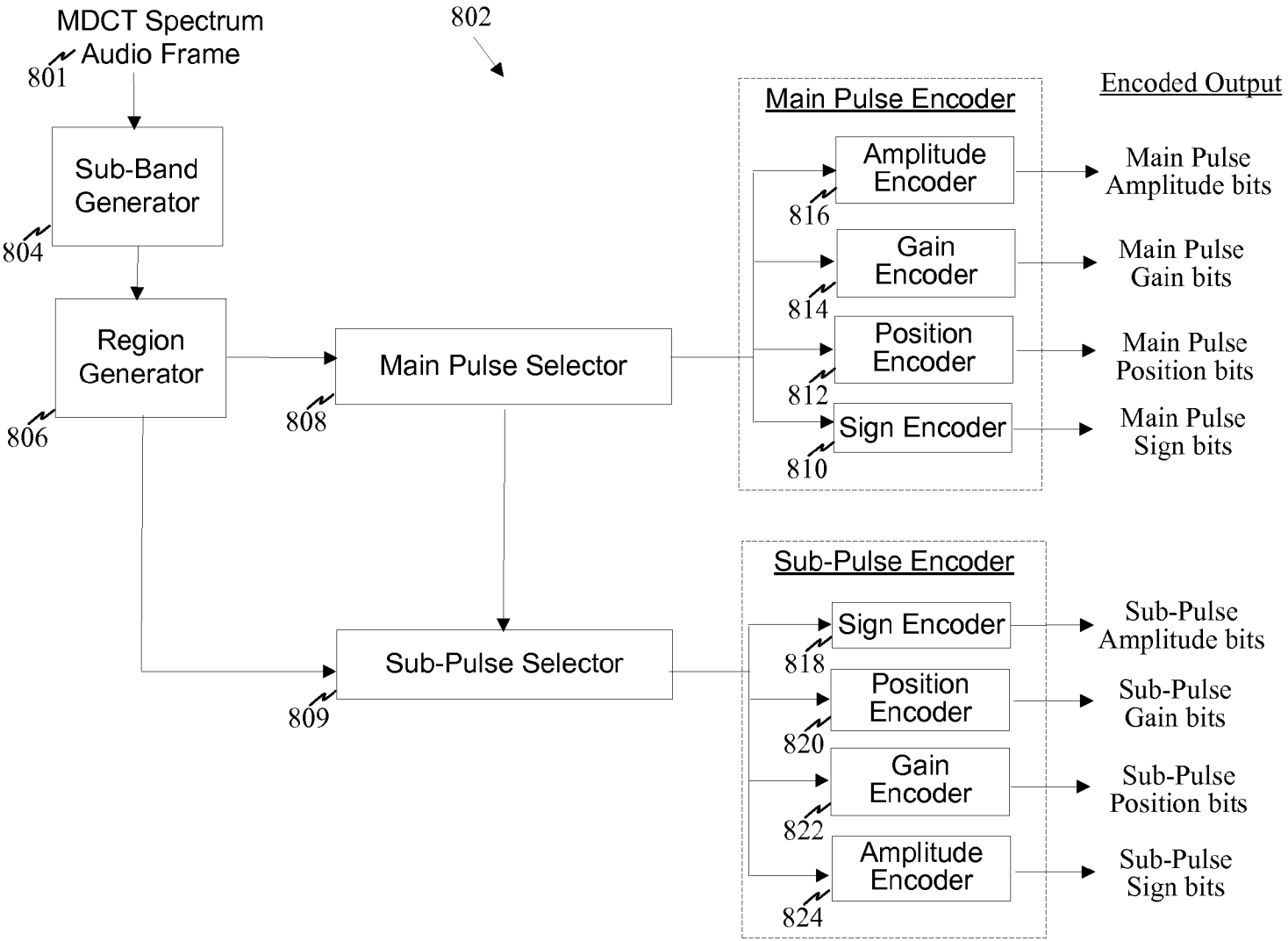
FIG. 8 is a block diagram illustrating an encoder that may efficiently encode pulses in an MDCT audio frame.

FIG. 8 is a block diagram illustrating an encoder that may efficiently encode pulses in an MDCT audio frame. The encoder 802 may include a sub-band generator 802 that divides a received MDCT spectrum audio frame 801 into multiple bands having a plurality of spectral lines. A region generator 806 then generates a plurality of overlapping regions, where each region consists of a plurality of contiguous sub-bands. A main pulse selector 808 then selects a main pulse from each of the sub-bands in a region. A main pulse may be the pulse (one or more spectral lines or points) having the greatest amplitude/magnitude within a sub-band. The selected main pulse for each sub-band in a region is then encoded by a sign encoder 810, a position encoder 812, a gain encoder 814, and an amplitude encoder 816 to generate corresponding encoded bits for each main pulse. Similarly, sub-pulse selector 809 then selects a plurality (e.g., four) sub-pulses from across the region (i.e., without regard as to which sub-band the sub-pulses belong). The sub-pulses may be selected from the remaining pulses in the region (i.e., excluding the already selected main pulses) having the greatest amplitude/magnitude within a sub-band. The selected sub-pulses for the region are then encoded by a sign encoder 818, a position encoder 820, a gain encoder 822, and an amplitude encoder 822 to generate corresponding encoded bits for the sub-pulse. The position encoder 820 may be configured to perform a combinatorial position coding technique to generate a lexicographical index that reduces the overall size of bits that are used to encode the position of the sub-pulses. In particular, where only a few of the pulses in the whole region are to be encoded, it is more efficient to represent the few sub-pulses as a lexicographic index than representing the full length of the region.

Figure 9:
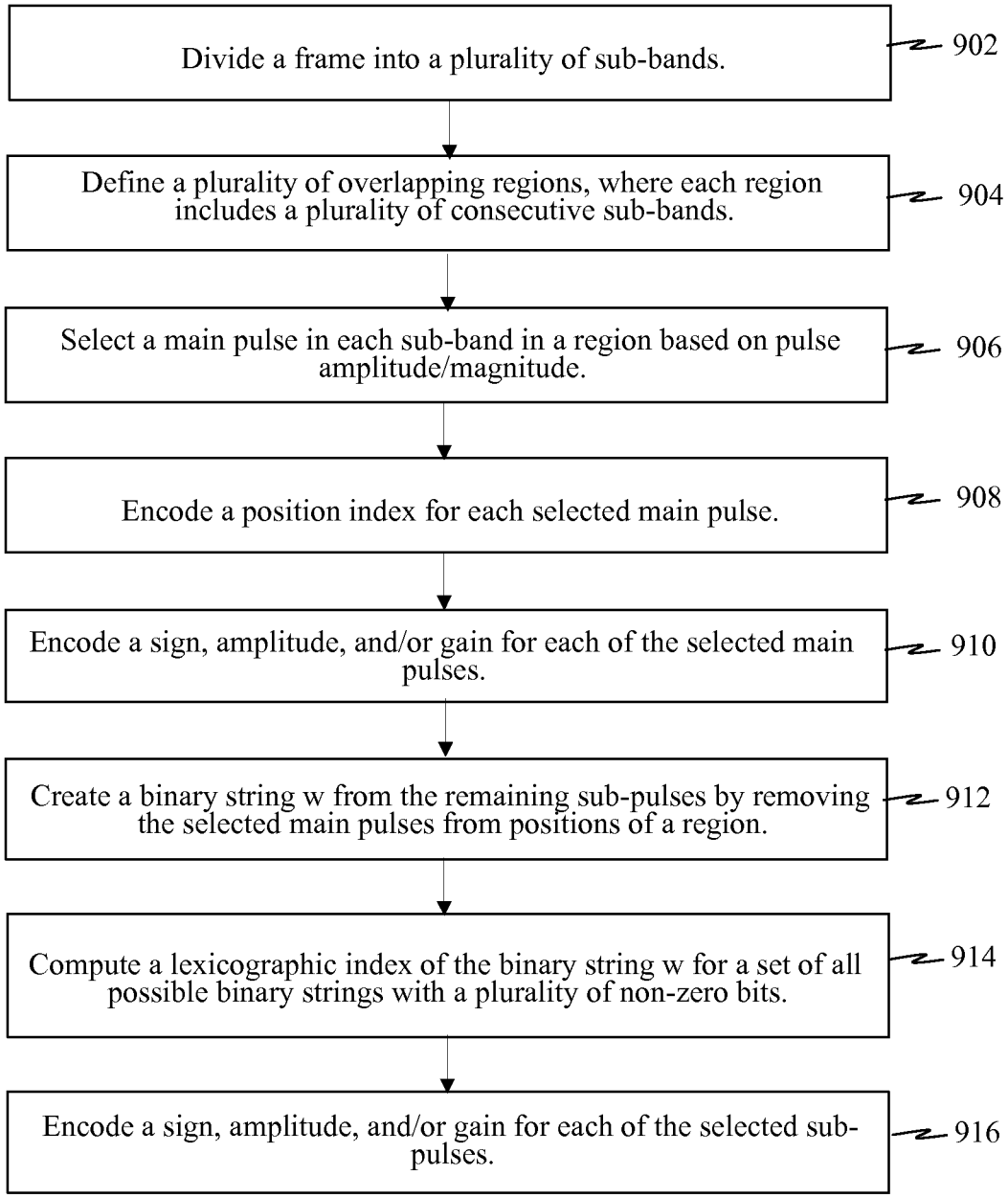
FIG. 9 is a flow diagram illustrating a method for obtaining a shape vector for a frame.

FIG. 9 is a flow diagram illustrating a method for obtaining a shape vector for a frame. As indicated earlier, the shape vector consists of 5 main and 4 sub-pulses (spectral lines), which position locations (within 80-lines region) and signs are to be communicated by using the fewest possible number of bits.

For this example, the several assumptions are made about the characteristics of main and sub-pulses. First, the magnitude of main pulses is assumed to be higher than the magnitude of sub-pulses, and that ratio may be a preset constant (e.g. 0.8). This means that proposed quantization technique may assigns one of three possible reconstruction levels (magnitudes) to the MDCT spectrum in each sub-band: zero (0), sub-pulse level (e.g. 0.8), and main pulse level (e.g., 1). Second, it is assumed that each 16-point (16-spectral line) sub-band has exactly one main pulse (with dedicated gain, which is also transmitted once per sub-band). Consequently, a main pulse is present for each sub-band in a region. Third, the remaining four (4) (or fewer) sub-pulses can be injected in any sub-band in the 80-lines region, but they should not displace any of the selected main pulses. A sub-pulse may represent the maximum number of bits used to represent the spectral lines in the sub-band. For instance, four (4) sub-pulses in a sub-band can represent 16 spectral lines in any sub-band, thus, the maximum number of bits used to represent 16 spectral lines in a sub-band is 4.

Based on the above description, an encoding method for pulses can be derived as follows. A frame (having a plurality of spectral lines) is divided into a plurality of sub-bands 902. A plurality of overlapping regions may be defined, where each region includes a plurality of consecutive/contiguous sub-bands 904. A main pulse is selected in each sub-band in the region based on pulse amplitude/magnitude 906. A position index is encoded for each selected main pulse 908. In one example, because a main pulse may fall anywhere within a sub-band having 16 spectral lines, its position can be represented by 4 bits (e.g., integer value in 0 . . . 15). Similarly, a sign, amplitude, and/or gain may be encoded for each of the main pulses 910. The sign may be represented by 1 bit (either a 1 or 0). Because each index for a main pulse will take 4 bits, 20 bits may be used to represent five main pulse indices (e.g., 5 sub-bands) and 5 bits for the signs of the main pulses, in addition to the bits used for gain and amplitude encoding for each main pulse.

For encoding of sub-pulses, a binary string is created from a selected plurality of sub-pulses from the remaining pulses in a region, where the selected main pulses are removed 912. The "selected plurality of sub-pulses" may be a number k of pulses having the greatest magnitude/amplitude from the remaining pulses. Also, for a region having 80 spectral lines, if all 5 main pulses are remove, this leaves 80−5=75 positions for sub-pulses to consider. Consequently, a 75-bit binary string w can be created consisting of:

0: indicating no sub-pulse

1: indicating presence of a selected sub-pulse in a position.

A lexicographic index is then computed of this binary string w for a set of all possible binary strings with a plurality k of non-zero bits 914. A sign, amplitude, and/or gain may also be encoded for each of the selected sub-pulses 916.

Generating Lexicographic Index

The lexicographic index representing the selected sub-pulses may be generated using a combinatorial position coding technique based on binomial coefficients. For example, the binary string w may be computed for a set of all possible $$\binom{n}{k}$$

binary strings of length n with k non-zero bits (each non-zero bit in the string w indicating the position of a pulse to be encoded). In one example, the following combinatorial formula may be used to generate an index that encodes the position of all k pulses within the binary string w:

$$\text{index}(n, k, w) = i(w) = \sum_{j=1}^{n} w_j \binom{n-j}{\sum_{i=j}^{n} w_i}$$

where n is the length of the binary string (e.g., n=75), k is the number of selected sub-pulses (e.g., k=4), $w_j$ represents individual bits of the binary string w, and it is assumed that $$\binom{n}{k} = 0$$

for all k>n. For the example where k=4 and n=75, the total range of values occupied by indices of all possible sub-pulse vectors, therefore will be:

$$\binom{75}{4} + \binom{75}{3} + \binom{75}{2} + \binom{75}{1} + \binom{75}{0} = 1285826$$

Hence, this can be represented $\log_2 1285826 \approx 20.294 \ldots$ bits. Using the nearest integer will result in 21 bits usage. Note that this is smaller than the 75 bits for the binary string or the bits remaining in the 80-bit region.

Example of Generating Lexicographical Index from String

According to one example, a lexicographical index for a binary string representing the positions of selected sub-pulses may be calculated based on binomial coefficients, which in one possible implementation can be pre-computed and stored in a triangular array (Pascal's triangle) as follows:

```
/* maximum value of n: */
#define N_MAX 32
/* Pascal's triangle: */
static unsigned *binomial[N_MAX+1], b_data[(N_MAX+1) *
(N_MAX+2) / 2];
/* initialize Pascal triangle */
```

-continued

```
static void compute__binomial__coeffs (void)
{
int n, k; unsigned *b = b__data;
for (n=0; n<=N__MAX; n++) {
    binomial[n] = b; b += n + 1; /* allocate a row */
    binomial[n][0] = binomial[n][n] = 1; /* set 1st & last coeffs */
    for (k=1; k<n; k++) {
        binomial[n][k] = binomial[n−1][k−1] + binomial[n−1][k];
        }
    }
}
```

Consequently, a binomial coefficient may be calculated for a binary string w representing a plurality of sub-pulses (e.g., a binary "1") at various positions of the binary string w.

Using this array of binomial coefficients, the computation of a lexicographic index (i) can be implemented as follows:

```
/* get index of a (n,k) sequence: */
static int index (unsigned w, int n, int k)
{
int i=0, j;
for (j=1; j<=n; j++) {
    if (w & (1 << n−j)) {
        if (n−j >= k)
            i += binomial[n−j][k];
            k−−;
        }
    }
return i;
}
```

Example Encoding Method

Figure 10:
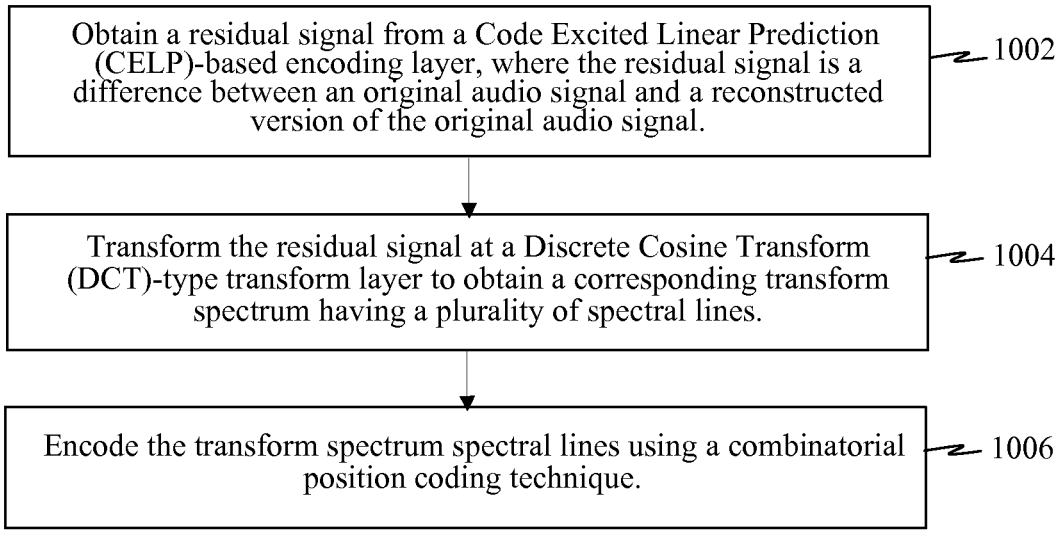
FIG. 10 is a block diagram illustrating a method for encoding a transform spectrum in a scalable speech and audio codec.

FIG. 10 is a block diagram illustrating a method for encoding a transform spectrum in a scalable speech and audio codec. A residual signal is obtained from a Code Excited Linear Prediction (CELP)-based encoding layer, where the residual signal is a difference between an original audio signal and a reconstructed version of the original audio signal 1002. The reconstructed version of the original audio signal may be obtained by: (a) synthesizing an encoded version of the original audio signal from the CELP-based encoding layer to obtain a synthesized signal, (b) re-emphasizing the synthesized signal, and/or (c) up-sampling the re-emphasized signal to obtain the reconstructed version of the original audio signal.

The residual signal is transformed at a Discrete Cosine Transform (DCT)-type transform layer to obtain a corresponding transform spectrum having a plurality of spectral lines 1004. The DCT-type transform layer may be a Modified Discrete Cosine Transform (MDCT) layer and the transform spectrum is an MDCT spectrum.

The transform spectrum spectral lines are encoded using a combinatorial position coding technique 1006. Encoding of the transform spectrum spectral lines may include encoding positions of a selected subset of spectral lines based on representing spectral line positions using the combinatorial position coding technique for non-zero spectral lines positions. In some implementations, a set of spectral lines may be dropped to reduce the number of spectral lines prior to encoding. In another example, the combinatorial position coding technique may include generating a lexicographical index for a selected subset of spectral lines, where each lexicographic index represents one of a plurality of possible binary strings representing the positions of the selected subset of spectral lines. The lexicographical index may represent spectral lines in binary string in fewer bits than the length of the binary string.

In another example, the combinatorial position coding technique may include generating an index representative of positions of spectral lines within a binary string, the positions of the spectral lines being encoded based a combinatorial formula:

$$\text{index}(n, k, w) = i(w) = \sum_{j=1}^{n} w_j \left( \sum_{i=j}^{n} w_i \right)$$

where n is the length of the binary string, k is the number of selected spectral lines to be encoded, and $w_j$ represents individual bits of the binary string.

In one example, the plurality of spectral lines may be split into a plurality of sub-bands and consecutive sub-bands may be grouped into regions. A main pulse selected from a plurality of spectral lines for each of the sub-bands in the region may be encoded, where the selected subset of spectral lines in the region excludes the main pulse for each of the sub-bands. Additionally, positions of a selected subset of spectral lines within a region may be encoded based on representing spectral line positions using the combinatorial position coding technique for non-zero spectral lines positions. The selected subset of spectral lines in the region may exclude the main pulse for each of the sub-bands. Encoding of the transform spectrum spectral lines may include generating an array, based on the positions of the selected subset of spectral lines, of all possible binary strings of length equal to all positions in the region. The regions may be overlapping and each region may include a plurality of consecutive sub-bands.

The process of decoding the lexicographic index to synthesize the encoded pulses is simply a reversal of the operations described for encoding.

Decoding of MDCT Spectrum

Figure 11:
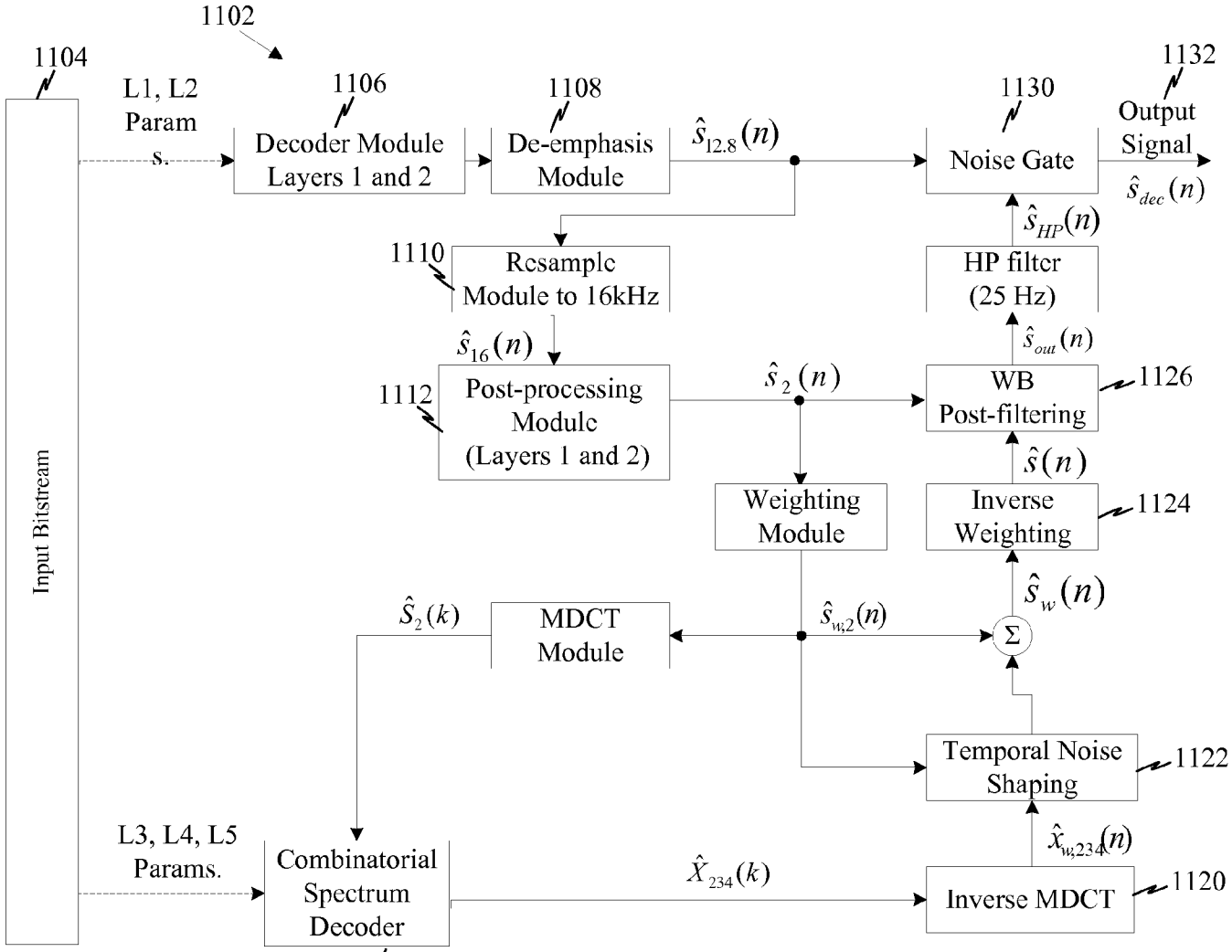
FIG. 11 is a block diagram illustrating an example of a decoder.

FIG. 11 is a block diagram illustrating an example of a decoder. In each audio frame (e.g., 20 millisecond frame), the decoder 1102 may receive an input bitstream 1104 containing information of one or more layers. The received layers may range from Layer 1 up to Layer 5, which may correspond to bit rates of 8 kbit/s to 32 kbit/s. This means that the decoder operation is conditioned by the number of bits (layers), received in each frame. In this example, it is assumed that the output signal 1132 is WB and that all layers have been correctly received at the decoder 1102. The core layer (Layer 1) and the ACELP enhancement layer (Layer 2) are first decoded by a decoder module 1106 and signal synthesis is performed. The synthesized signal is then de-emphasized by a de-emphasis module 1108 and resampled to 16 kHz by a resampling module 1110 to generate a signal $\hat{s}_{16}(n)$. A post-processing module further processes the signal $\hat{s}_{16}(n)$ to generate a synthesized signal $\hat{s}_2(n)$ of the Layer 1 or Layer 2.

Higher layers (Layers 3, 4, 5) are then decoded by a combinatorial spectrum decoder module 1116 to obtain an MDCT spectrum signal $\hat{X}_{234}(k)$. The MDCT spectrum signal $\hat{X}_{234}(k)$ is inverse transformed by inverse MDCT module 1120 and the resulting signal $\hat{x}_{w,234}(n)$ is added to the perceptually weighted synthesized signal $\hat{s}_{w,2}(n)$ of Layers 1 and 2. Temporal noise shaping is then applied by a shaping module 1122. A weighted synthesized signal $\hat{s}_{w,2}(n)$ of the previous frame overlapping with the current frame is then added to the synthesis. Inverse perceptual weighting 1124 is then applied to restore the synthesized WB signal. Finally, a pitch post-filter 1126 is applied on the restored signal followed by a high-pass filter 1128. The post-filter 1126 exploits the extra decoder delay introduced by the overlap-add synthesis of the MDCT (Layers 3, 4, 5). It combines, in an optimal way, two pitch post-filter signals. One is a high-quality pitch post-filter signal $\hat{s}_2(n)$ of the Layer 1 or Layer 2 decoder output that is generated by exploiting the extra decoder delay. The other is a low-delay pitch post-filter signal $\hat{s}(n)$ of the higher-layers (Layers 3, 4, 5) synthesis signal. The filtered synthesized signal $\hat{s}_{HP}(n)$ is then output by a noise gate 1130.

Figure 12:
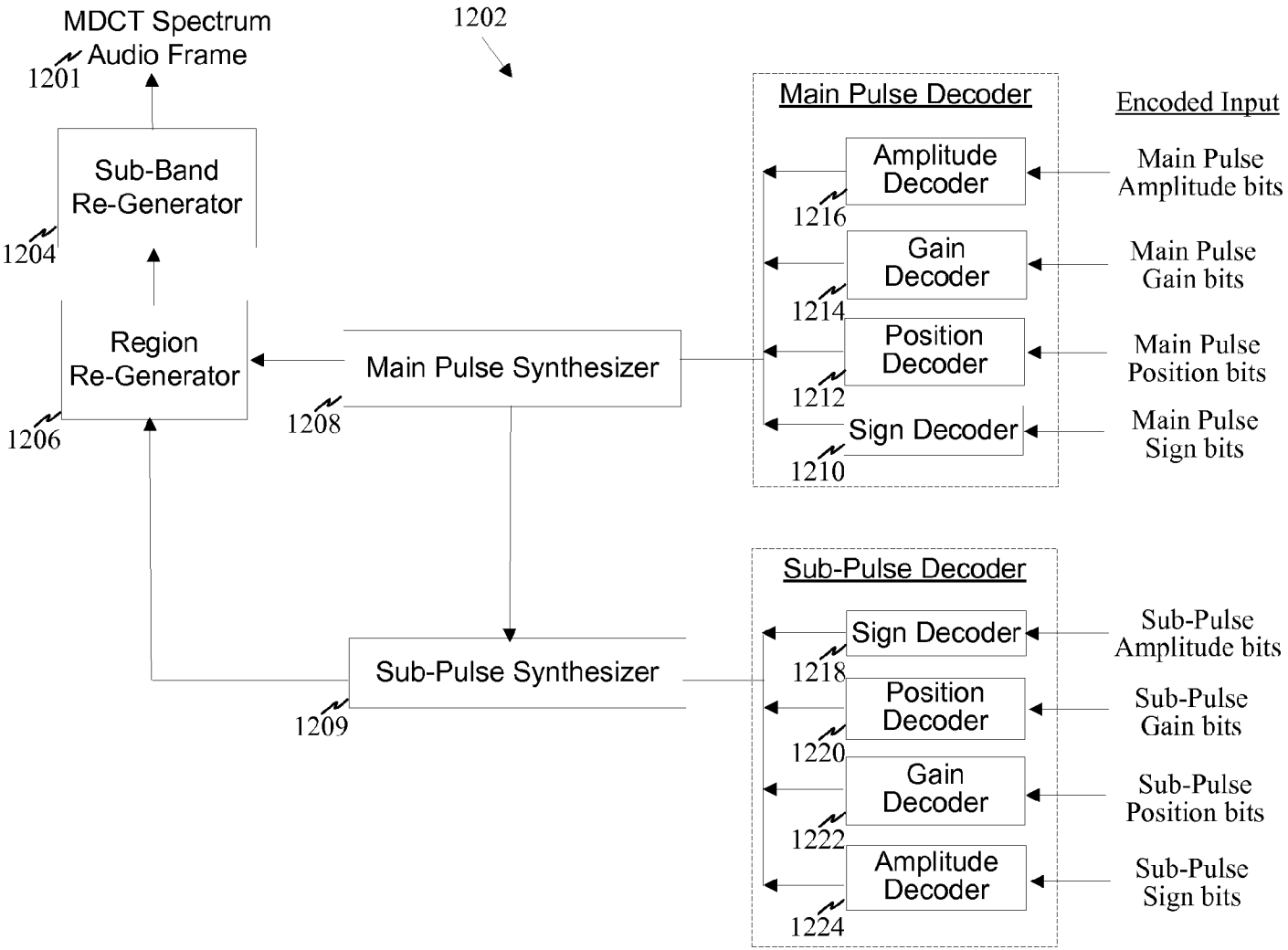
FIG. 12 is a block diagram illustrating a method for encoding a transform spectrum in a scalable speech and audio codec.

FIG. 12 is a block diagram illustrating a decoder that may efficiently decode pulses of an MDCT spectrum audio frame. A plurality of encoded input bits are received including sign, position, amplitude, and/or gain for main and/or sub-pulses in an MDCT spectrum for an audio frame. The bits for one or more main pulses are decoded by a main pulse decoder that may include a sign decoder 1210, a position decoder 1212, a gain decoder 1214, and/or an amplitude decoder 1216. A main pulse synthesizer 1208 then reconstructs the one or more main pulses using the decoded information. Likewise, the bits for one or more sub-pulses may be decoded at a sub-pulse decoder that includes a sign decoder 1218, a position decoder 1220, a gain decoder 1222, and/or an amplitude decoder 1224. Note that the position of the sub-pulses may be encoded using a lexicographic index based on a combinatorial position coding technique. Consequently, the position decoder 1220 may be a combinatorial spectrum decoder. A sub-pulse synthesizer 1209 then reconstructs the one or more sub-pulses using the decoded information. A region re-generator 1206 then regenerates a plurality of overlapping regions in based on the sub-pulses, where each region consists of a plurality of contiguous sub-bands. A sub-band regenerator 1204 then regenerates the sub-bands using the main pulses and/or sub-pulses leading to a reconstructed MDCT spectrum for an audio frame 1201.

Example of Generating String from Lexicographical Index

To decode the received lexicographic index representing the position of the sub-pulses, an inverse process may be performed to obtain a sequence or binary string based on a given the given lexicographic index. One example of such inverse process can be implemented as follows:

```
/* generate an (n,k) sequence using its index: */
static unsigned make_sequence (int i, int n, int k)
{
unsigned j, b, w = 0;
for (j=1; j<=n; j++) {
    if (n−j < k) goto 11;
    b = binomial[n−j][k];
        if (i >= b) {
            i −= b;
            11:
            w |= 1U << (n−j);
            k−−;
        }
    }
return w;
}
```

In the case of a long sequence (e.g., where n=75) with only few bits set (e.g., where k=4) this routine can be further modified to make them more practical. For instance, instead of searching through the sequence of bits, indices of non-zero bits can be passed for encoding, so that the index( ) function becomes:

```
/* j0...j3 – indices of non-zero bits: */
static int index (int n, int j0, int j1, int j3, int j4)
{
int i=0;
if (n−j0 >= 4) i += binomial[n−j0][4];
if (n−j1 >= 3) i += binomial[n−j1][3];
if (n−j2 >= 2) i += binomial[n−j2][2];
if (n−j3 >= 2) i += binomial[n−j3][1];
return i;
}
```

Note that only the first 4 columns of a binomial array are used. Hence, only 75*4=300 words of memory are used to store it.

In one example, the decoding process can be accomplished by the following algorithm:

```
static void decode_indices (int i, int n, int *j0, int *j1, int *j2, int *j3)
{
unsigned b, j;
for (j=1; j<=n−4; j++) {
    b = binomial[n−j][4];
    if (i >= b) {i −= b; break;}
}
*j0 = n−j;
for (j++; j<=n−3; j++) {
    b = binomial [n−j][3];
    if (i >= b) {i −= b; break;}
}
*j1 = n−j;
for (j++; j<=n−2; j++) {
    b = binomial[n−j][2];
    if (i >= b) (i −= b; break;}
}
*j2 = n−j;
for (j++; j<=n−1; j++) {
    b = binomial[n−j][1];
    if (i >= b) break;
}
*j3 = n−j;
}
```

This is an unrolled loop with n iterations with only lookups and comparisons used at each step.

Example Encoding Method

Figure 13:
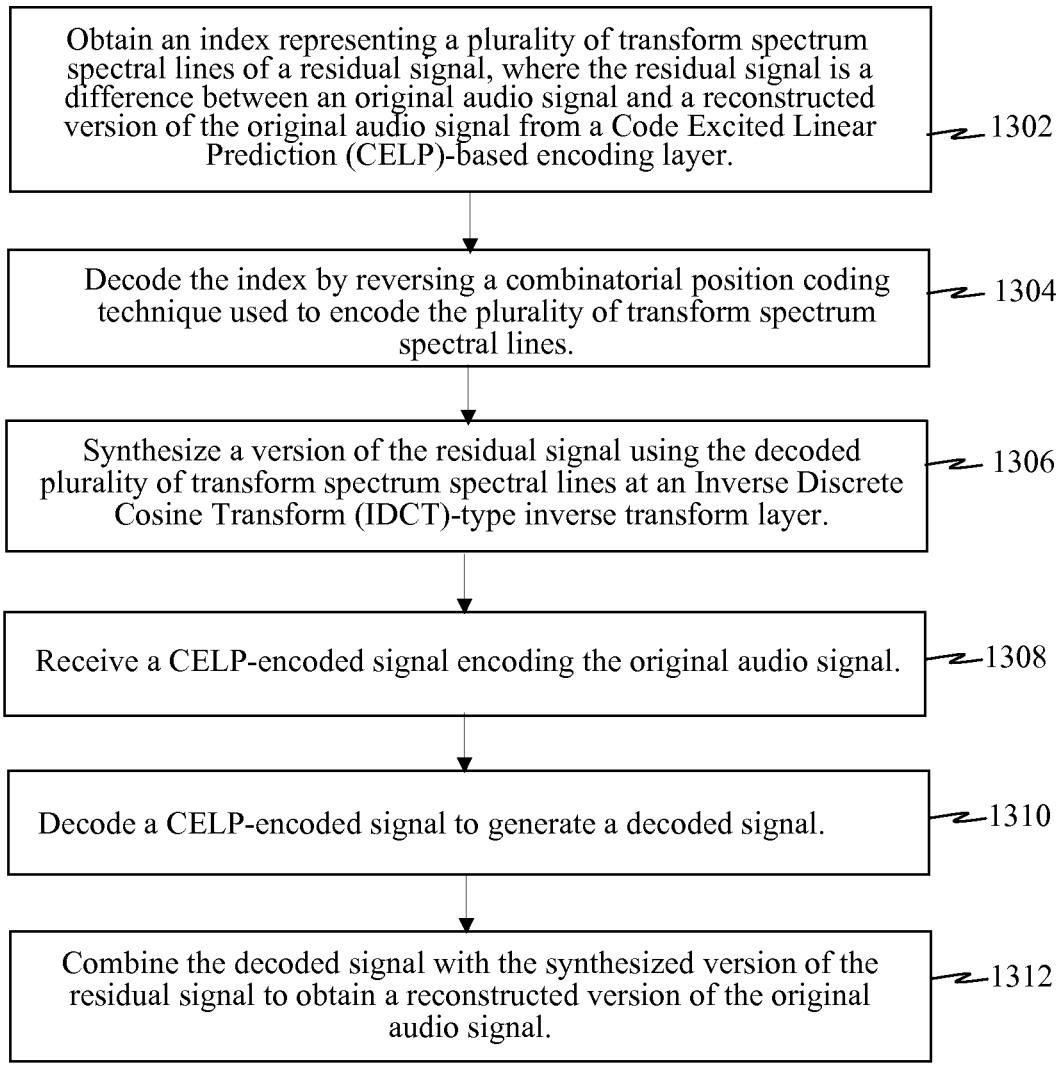
FIG. 13 is a block diagram illustrating a method for decoding a transform spectrum in a scalable speech and audio codec.

FIG. 13 is a block diagram illustrating a method for decoding a transform spectrum in a scalable speech and audio codec. An index representing a plurality of transform spectrum spectral lines of a residual signal is obtained, where the residual signal is a difference between an original audio signal and a reconstructed version of the original audio signal from a Code Excited Linear Prediction (CELP)-based encoding layer 1302. The index may represent non-zero spectral lines in a binary string in fewer bits than the length of the binary string. In one example, the obtained index may represent positions of spectral lines within a binary string, the positions of the spectral lines being encoded based a combinatorial formula:

$$\text{index}(n, k, w) = i(w) = \sum_{j=1}^{n} w_j \left( \sum_{i=j}^{n} w_i \right)^{n-j}$$

where n is the length of the binary string, k is the number of selected spectral lines to be encoded, and $w_j$ represents individual bits of the binary string.

The index is decoded by reversing a combinatorial position coding technique used to encode the plurality of transform spectrum spectral lines 1304. A version of the residual signal is synthesized using the decoded plurality of transform spectrum spectral lines at an Inverse Discrete Cosine Transform (IDCT)-type inverse transform layer 1306. Synthesizing a version of the residual signal may include applying an inverse DCT-type transform to the transform spectrum spectral lines to produce a time-domain version of the residual signal. Decoding the transform spectrum spectral lines may include decoding positions of a selected subset of spectral lines based on representing spectral line positions using the combinatorial position coding technique for non-zero spectral lines positions. The DCT-type inverse transform layer may be an Inverse Modified Discrete Cosine Transform (IMDCT) layer and the transform spectrum is an MDCT spectrum.

Additionally a CELP-encoded signal encoding the original audio signal may be received 1308. The CELP-encoded signal may be decoded to generate a decoded signal 1310. The decoded signal may be combined with the synthesized version of the residual signal to obtain a (higher-fidelity) reconstructed version of the original audio signal 1312.

The various illustrative logical blocks, modules and circuits and algorithm steps described herein may be implemented or performed as electronic hardware, software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. It is noted that the configurations may be described as a process that is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function.

When implemented in hardware, various examples may employ a general purpose processor, a digital signal processor (DSP), an application specific integrated circuit (ASIC), a field programmable gate array signal (FPGA) or other programmable logic device, discrete gate or transistor logic, discrete hardware components or any combination thereof designed to perform the functions described herein. A general purpose processor may be a microprocessor, but in the alternative, the processor may be any conventional processor, controller, microcontroller or state machine. A processor may also be implemented as a combination of computing devices, e.g., a combination of a DSP and a microprocessor, a plurality of microprocessors, one or more microprocessors in conjunction with a DSP core or any other such configuration.

When implemented in software, various examples may employ firmware, middleware or microcode. The program code or code segments to perform the necessary tasks may be stored in a computer-readable medium such as a storage medium or other storage(s). A processor may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

As used in this application, the terms "component," "module," "system," and the like are intended to refer to a computer-related entity, either hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets (e.g., data from one component interacting with another component in a local system, distributed system, and/or across a network such as the Internet with other systems by way of the signal).

In one or more examples herein, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media. Software may comprise a single instruction, or many instructions, and may be distributed over several different code segments, among different programs and across multiple storage media. An exemplary storage medium may be coupled to a processor such that the processor can read information from, and write information to, the storage medium. In the alternative, the storage medium may be integral to the processor.

The methods disclosed herein comprise one or more steps or actions for achieving the described method. The method steps and/or actions may be interchanged with one another without departing from the scope of the claims. In other words, unless a specific order of steps or actions is required for proper operation of the embodiment that is being described, the order and/or use of specific steps and/or actions may be modified without departing from the scope of the claims.

One or more of the components, steps, and/or functions illustrated in FIGS. 1, 2, 3, 4, 5, 6, 7, 8, 9, 10, 11, 12, and/or 13 may be rearranged and/or combined into a single component, step, or function or embodied in several components, steps, or functions. Additional elements, components, steps, and/or functions may also be added. The apparatus, devices, and/or components illustrated in FIGS. 1, 2, 3, 4, 5, 8, 11 and 12 may be configured or adapted to perform one or more of the methods, features, or steps described in FIGS. 6-7 and 10-13. The algorithms described herein may be efficiently implemented in software and/or embedded hardware.

It should be noted that the foregoing configurations are merely examples and are not to be construed as limiting the claims. The description of the configurations is intended to be illustrative, and not to limit the scope of the claims. As such, the present teachings can be readily applied to other types of apparatuses and many alternatives, modifications, and variations will be apparent to those skilled in the art.

What is claimed is:

1. A method for encoding in a scalable speech and audio codec having multiple layers, comprising:

obtaining a residual signal from a Code Excited Linear Prediction (CELP)-based encoding layer, wherein the CELP-based encoding layer comprises one or two previous layers in the scalable and audio codec, and where the residual signal is a difference between an original audio signal and a reconstructed version of the original audio signal;

transforming the residual signal, from a previous layer, at a Discrete Cosine Transform (DCT)-type transform layer to obtain a corresponding transform spectrum having a plurality of spectral lines; and encoding the transform spectrum spectral lines using a combinatorial position coding technique; and splitting the plurality of spectral lines into a plurality of sub-bands; and grouping consecutive sub-bands into regions; and encoding positions of a selected subset of spectral lines within a region based on representing spectral line positions using the combinatorial position coding technique for non-zero spectral lines positions.

2. The method of claim 1, wherein the DCT-type transform layer is a Modified Discrete Cosine Transform (MDCT) layer and the transform spectrum is an MDCT spectrum.

3. The method of claim 1, wherein encoding of the transform spectrum spectral lines includes:

encoding positions of a selected subset of spectral lines based on representing spectral line positions using the combinatorial position coding technique for non-zero spectral lines positions.

4. The method of claim 1, further comprising:

encoding a main pulse selected from a plurality of spectral lines for each of the sub-bands in the region.

5. The method of claim 1, wherein encoding of the transform spectrum spectral lines includes generating an array, based on the positions of the selected subset of spectral lines, of all possible binary strings of length equal to all positions in the region.

6. The method of claim 1, wherein the regions are overlapping and each region includes a plurality of consecutive sub-bands.

7. The method of claim 1, wherein the combinatorial position coding technique includes:

generating an index representative of positions of spectral lines within a binary string, the positions of the spectral lines being encoded based a combinatorial formula:

$$\text{index}(n, k, w) = i(w) = \sum_{i=1}^{n} w_j \left( \sum_{i=j}^{n} w_i \right)^{n-j}$$

where n is the length of the binary string, k is the number of selected spectral lines to be encoded, and $w_j$ represents individual bits of the binary string.

8. The method of claim 1, further comprising:

dropping a set of spectral lines to reduce the number of spectral lines prior to encoding.

9. The method of claim 1, wherein the reconstructed version of the original audio signal is obtained by:

synthesizing an encoded version of the original audio signal from the CELP-based encoding layer to obtain a synthesized signal;

re-emphasizing the synthesized signal; and up-sampling the re-emphasized signal to obtain the reconstructed version of the original audio signal.

10. The method of claim 1, wherein the combinatorial position coding technique includes:

generating a lexicographical index for a selected subset of spectral lines, where each lexicographic index represents one of a plurality of possible binary strings representing the positions of the selected subset of spectral lines.

11. The method of claim 10, wherein the lexicographical index represents non-zero spectral lines in a binary string in fewer bits than the length of the binary string.

12. A scalable speech and audio encoder device, comprising:

a Code Excited Linear Prediction (CELP)-based encoding layer module adapted to produce a residual signal, where the residual signal is a difference between an original audio signal and a reconstructed version of the original audio signal;

a Discrete Cosine Transform (DCT)-type transform layer module adapted to obtain a residual signal from the Code Excited Linear Prediction (CELP)-based encoding layer module, wherein the CELP-based encoding layer module comprises a CELP-based encoding layer having one or two previous layers scalable speech and audio codec; and transform the residual signal, from a previous layer, at a Discrete Cosine Transform (DCT)-type transform layer to obtain a corresponding transform spectrum having a plurality of spectral lines; and a sub-band generator adapted to split the plurality of spectral lines into a plurality of sub-bands; and a region generator adapted to group consecutive sub-bands into regions; and a sub-pulse encoder adapted to encode positions of a selected subset of spectral lines within a region based on representing spectral line positions using the combinatorial position coding technique for non-zero spectral lines positions.

13. The device of claim 12, wherein the DCT-type transform layer module is a Modified Discrete Cosine Transform (MDCT) layer module and the transform spectrum is an MDCT spectrum.

14. The device of claim 12, wherein encoding of the transform spectrum spectral lines includes:

encoding positions of a selected subset of spectral lines based on representing spectral line positions using the combinatorial position coding technique for non-zero spectral lines positions.

15. The device of claim 12, further comprising:

a main pulse encoder adapted to encode a main pulse selected from a plurality of spectral lines for each of the sub-bands in the region.

16. The device of claim 12:

wherein encoding of the transform spectrum spectral lines includes generating an array, based on the positions of the selected subset of spectral lines, of all possible binary strings of length equal to all positions in the region.

17. The device of claim 12, wherein the regions are overlapping and each region includes a plurality of consecutive sub-bands.

18. The device of claim 12, wherein the combinatorial spectrum encoder is adapted to generate an index representative of positions of spectral lines within a binary string, the positions of the spectral lines being encoded based a combinatorial formula:

$$\text{index}(n, k, w) = i(w) = \sum_{j=1}^{n} w_j \binom{n-j}{\sum_{i=j}^{n} w_i}$$

where n is the length of the binary string, k is the number of selected spectral lines to be encoded, and $w_j$ represents individual bits of the binary string.

19. The device of claim 12, wherein the reconstructed version of the original audio signal is obtained by:

synthesizing an encoded version of the original audio signal from the CELP-based encoding layer to obtain a synthesized signal;

re-emphasizing the synthesized signal; and up-sampling the re-emphasized signal to obtain the reconstructed version of the original audio signal.

20. The device of claim 12, wherein the combinatorial position coding technique includes:

generating a lexicographical index for a selected subset of spectral lines, where each lexicographic index represents one of a plurality of possible binary strings representing the positions of the selected subset of spectral lines.

21. The device of claim 20, wherein the lexicographical index represents non-zero spectral lines in a binary string in fewer bits than the length of the binary string.

22. The device of claim 12, further comprising a combinatorial spectrum encoder adapted to encode the transform spectrum spectral lines using a combinatorial position coding technique.

23. A scalable speech and audio encoder device, comprising:

means for obtaining a residual signal from a Code Excited Linear Prediction (CELP)-based encoding layer, wherein the CELP-based encoding layer comprises one or two previous layers in a scalable speech and audio codec, where the residual signal is a difference between an original audio signal and a reconstructed version of the original audio signal;

means for transforming the residual signal, from a previous layer, at a Discrete Cosine Transform (DCT)-type transform layer to obtain a corresponding transform spectrum having a plurality of spectral lines; and means for splitting the plurality of spectral lines into a plurality of sub-bands; and means for grouping consecutive sub-bands into regions; and means for encoding positions of a selected subset of spectral lines within a region based on representing spectral line positions using the combinatorial position coding technique for non-zero spectral lines positions.

24. The device of claim 23, further comprising means for encoding the transform spectrum spectral lines using a combinatorial position coding technique.

25. A processor including a scalable speech and audio encoding circuit adapted to:

obtain a residual signal from a Code Excited Linear Prediction (CELP)-based encoding layer, wherein the CELP-based encoding layer comprises one or two previous layers in a scalable speech and audio codec, where the residual signal is a difference between an original audio signal and a reconstructed version of the original audio signal;

transform the residual signal, from a previous layer, at a Discrete Cosine Transform (DCT)-type transform layer to obtain a corresponding transform spectrum having a plurality of spectral lines; and split the plurality of spectral lines into a plurality of sub-bands; and group consecutive sub-bands into regions; and encode positions of a selected subset of spectral lines within a region based on representing spectral line positions using the combinatorial position coding technique for non-zero spectral lines positions.

26. The processor of claim 24, wherein the audio encoding circuit is further adapted to encode the transform spectrum spectral lines using a combinatorial position coding technique.

27. A non-transitory machine-readable medium comprising instructions operational for scalable speech and audio encoding, which when executed by one or more processors causes the processors to:

obtain a residual signal from a Code Excited Linear Prediction (CELP)-based encoding layer, wherein the CELP-based encoding layer comprises one or two previous layers in a scalable speech and audio codec, where the residual signal is a difference between an original audio signal and a reconstructed version of the original audio signal;

transform the residual signal, from a previous layer, at a Discrete Cosine Transform (DCT)-type transform layer to obtain a corresponding transform spectrum having a plurality of spectral lines; and split the plurality of spectral lines into a plurality of sub-bands; and group consecutive sub-bands into regions; and encode positions of a selected subset of spectral lines within a region based on representing spectral line positions using the combinatorial position coding technique for non-zero spectral lines positions.

28. The non-transitory machine-readable medium of claim 27, wherein the one or more processors is further caused to encode the transform spectrum spectral lines using a combinatorial position coding technique.

29. A method for decoding in a scalable speech and audio codec having multiple layers, comprising:

obtaining an index representing a plurality of transform spectrum spectral lines of a residual signal, where the residual signal is a difference between an original audio signal and a reconstructed version of the original audio signal from a Code Excited Linear Prediction (CELP)-based encoding layer, wherein the CELP-based encoding layer comprises one or two previous layers in a scalable speech and audio codec;

decoding the index, in a higher layer, by reversing a combinatorial position coding technique used to encode the plurality of transform spectrum spectral lines; and decoding positions of a selected subset of spectral lines based on representing spectral line positions using the combinatorial position coding technique for non-zero spectral lines positions; and synthesizing a version of the residual signal using the decoded plurality of transform spectrum spectral lines at an Inverse Discrete Cosine Transform (IDCT)-type inverse transform layer.

30. The method of claim 29, further comprising:

receiving a CELP-encoded signal encoding the original audio signal;

decoding a CELP-encoded signal to generate a decoded signal; and combining the decoded signal with the synthesized version of the residual signal to obtain a reconstructed version of the original audio signal.

31. The method of claim 29, wherein synthesizing a version of the residual signal includes applying an inverse DCT-type transform to the transform spectrum spectral lines to produce a time-domain version of the residual signal.

32. The method of claim 29, wherein the index represents non-zero spectral lines in a binary string in fewer bits than the length of the binary string.

33. The method of claim 29, wherein the DCT-type inverse transform layer is an Inverse Modified Discrete Cosine Transform (IMDCT) layer and the transform spectrum is an MDCT spectrum.

34. The method of claim 29, wherein the obtained index represents positions of spectral lines within a binary string, the positions of the spectral lines being encoded based a combinatorial formula:

$$\text{index}(n, k, w) = i(w) = \sum_{j=1}^{n} w_j \binom{n-j}{\sum_{i=j}^{n} w_i}$$

where n is the length of the binary string, k is the number of selected spectral lines to be encoded, and $w_j$ represents individual bits of the binary string.

35. A scalable speech and audio decoder device, comprising:

a combinatorial spectrum decoder adapted to obtain an index representing a plurality of transform spectrum spectral lines of a residual signal, where the residual signal is a difference between an original audio signal and a reconstructed version of the original audio signal from a Code Excited Linear Prediction (CELP)-based encoding layer module, wherein the CELP-based encoding layer module comprises a CELP-based encoding layer having one or two previous layers in a scalable speech and audio codec;

decode the index, in a higher layer, by reversing a combinatorial position coding technique used to encode the plurality of transform spectrum spectral lines; and decode positions of a selected subset of spectral lines based on representing spectral line positions using the combinatorial position coding technique for non-zero spectral lines positions; and an Inverse Discrete Cosine Transform (IDCT)-type inverse transform layer module adapted to synthesize a version of the residual signal using the decoded plurality of transform spectrum spectral lines.

36. The device of claim 35, further comprising:

a CELP decoder adapted to receive a CELP-encoded signal encoding the original audio signal;

decode a CELP-encoded signal to generate a decoded signal; and combine the decoded signal with the synthesized version of the residual signal to obtain a reconstructed version of the original audio signal.

37. The device of claim 35, wherein synthesizing a version of the residual signal, the (IDCT)-type inverse transform layer module is adapted to apply an inverse DCT-type transform to the transform spectrum spectral lines to produce a time-domain version of the residual signal.

38. The device of claim 35, wherein the index represents non-zero spectral lines in a binary string in fewer bits than the length of the binary string.

39. A scalable speech and audio decoder device, comprising:

means for obtaining an index representing a plurality of transform spectrum spectral lines of a residual signal, where the residual signal is a difference between an original audio signal and a reconstructed version of the original audio signal from a Code Excited Linear Prediction (CELP)-based encoding layer, wherein the CELP-based encoding layer comprises one or two previous layers in a scalable speech and audio codec;

means for decoding the index, in a higher layer, by reversing a combinatorial position coding technique used to encode the plurality of transform spectrum spectral lines; and means for decoding positions of a selected subset of spectral lines based on representing spectral line positions using the combinatorial position coding technique for non-zero spectral lines positions; and means for synthesizing a version of the residual signal using the decoded plurality of transform spectrum spectral lines at an Inverse Discrete Cosine Transform (IDCT)-type inverse transform layer.

40. A processor including a scalable speech and audio decoding circuit adapted to:

obtain an index representing a plurality of transform spectrum spectral lines of a residual signal, where the residual signal is a difference between an original audio signal and a reconstructed version of the original audio signal from a Code Excited Linear Prediction (CELP)-based encoding layer, wherein the CELP-based encoding layer comprises one or two previous layers in a scalable speech and audio codec;

decode the index, at a higher layer, by reversing a combinatorial position coding technique used to encode the plurality of transform spectrum spectral lines; and decode positions of a selected subset of spectral lines based on representing spectral line positions using the combinatorial position coding technique for non-zero spectral lines positions; and synthesize a version of the residual signal using the decoded plurality of transform spectrum spectral lines at an Inverse Discrete Cosine Transform (IDCT)-type inverse transform layer.

41. A non-transitory machine-readable medium comprising instructions operational for scalable speech and audio decoding, which when executed by one or more processors causes the processors to:

obtain an index representing a plurality of transform spectrum spectral lines of a residual signal, where the residual signal is a difference between an original audio signal and a reconstructed version of the original audio signal from a Code Excited Linear Prediction (CELP)-based encoding layer, wherein the CELP-based encoding layer comprises one or two previous layers in a scalable speech and audio codec;

decode the index, at a higher layer, by reversing a combinatorial position coding technique used to encode the plurality of transform spectrum spectral lines; and decode positions of a selected subset of spectral lines based on representing spectral line positions using the combinatorial position coding technique for non-zero spectral lines positions; and synthesize a version of the residual signal using the decoded plurality of transform spectrum spectral lines at an Inverse Discrete Cosine Transform (IDCT)-type inverse transform layer.

* * * * *